US009383666B1

(12) United States Patent
Lawton et al.

(10) Patent No.: US 9,383,666 B1
(45) Date of Patent: Jul. 5, 2016

(54) TONER PARTICLES COMPRISING BOTH POLYESTER AND STYRENE ACRYLATE POLYMERS HAVING A POLYESTER SHELL

(71) Applicant: XEROX CORPORATION, Norwalk, CT (US)

(72) Inventors: David J. W. Lawton, Oakville (CA); Richard P. N. Veregin, Mississauga (CA); Guerino G. Sacripante, Oakville (CA); Melanie Lynn Davis, Hamilton (CA); Edward G. Zwartz, Mississauga (CA)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/676,757

(22) Filed: Apr. 1, 2015

(51) Int. Cl.
*G03G 9/08* (2006.01)
*G03G 9/087* (2006.01)
*G03G 9/093* (2006.01)

(52) U.S. Cl.
CPC ..... *G03G 9/0808* (2013.01); *G03G 9/081* (2013.01); *G03G 9/0806* (2013.01); *G03G 9/0825* (2013.01); *G03G 9/08711* (2013.01); *G03G 9/08733* (2013.01); *G03G 9/093* (2013.01); *G03G 9/09392* (2013.01)

(58) Field of Classification Search
CPC ... G03G 9/0806; G03G 9/081; G03G 9/0825; G03G 9/08711; G03G 9/08733; G03G 9/093; G03G 9/09392
USPC ..... 430/137.14, 110.2
See application file for complete search history.

(56) References Cited

U.S. PATENT DOCUMENTS

| | | | |
|---|---|---|---|
| 3,590,000 | A | 6/1971 | Palmermiti et al. |
| 3,655,374 | A | 4/1972 | Palermiti et al. |
| 3,720,617 | A | 3/1973 | Chatterji et al. |
| 3,847,604 | A | 11/1974 | Hagenbach et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,298,672 | A | 11/1981 | Lu |
| 4,338,390 | A | 7/1982 | Lu |
| 4,394,430 | A | 7/1983 | Jadwin et al. |
| 4,560,635 | A | 12/1985 | Hoffend et al. |
| 4,935,326 | A | 6/1990 | Creatura et al. |
| 4,937,166 | A | 6/1990 | Creatura et al. |
| 5,227,560 | A | 7/1993 | Clement et al. |
| 6,004,714 | A | 12/1999 | Ciccarelli et al. |
| 6,063,827 | A | 5/2000 | Sacripante et al. |
| 6,120,967 | A | 9/2000 | Hopper et al. |
| 6,190,815 | B1 | 2/2001 | Ciccarelli et al. |
| 6,493,049 | B2 | 12/2002 | Iwane |
| 6,756,176 | B2 | 6/2004 | Stegamat et al. |
| 6,830,860 | B2 | 12/2004 | Sacripante et al. |
| 7,524,602 | B2 | 4/2009 | Vanbesien et al. |
| 8,192,913 | B2 | 6/2012 | Faucher et al. |
| 2006/0222991 | A1 | 10/2006 | Sacripante et al. |
| 2013/0164668 | A1 | 6/2013 | Sacripante et al. |
| 2014/0295346 | A1 | 10/2014 | Lawton et al. |

*Primary Examiner* — Mark A Chapman
(74) *Attorney, Agent, or Firm* — Pillsbury Winthrop Shaw Pittman LLP

(57) ABSTRACT

Toners and processes useful in providing toners suitable for electrophotographic apparatuses, including apparatuses such as digital, image-on-image, and similar apparatuses. In particular, emulsion aggregation toners that comprise toner particles having a core composed of either polyester resin or both styrene-acrylate and polyester resins. These embodiments also comprise a shell disposed over the core, wherein the shell comprises styrene-acrylate resin.

20 Claims, 5 Drawing Sheets

TONER PARTICLES COMPRISING BOTH POLYESTER AND STYRENE ACRYLATE POLYMERS HAVING A POLYESTER SHELL

TECHNICAL FIELD

The disclosure is generally directed to hybrid toner particles and methods for their preparation for use in forming toners. More specifically, the disclosure is directed to hybrid latex particles having a core of polyester and styrene acrylate polymers with a shell comprised largely of styrene acrylate polymer, and methods for their preparation for use in forming toners.

BACKGROUND

Toners made by emulsion aggregation processes are useful in forming print and xerographic images. Emulsion aggregation processes typically involve the formation of a latex emulsion of polymer particles by heating a polymer in water, optionally with a solvent if needed, or by forming a latex emulsion of polymer particles using phase inversion emulsion (PIE). Additives such as emulsifying agents or surfactants, colorants, waxes, aggregating agents, and others may be included in the emulsion. The resulting latex particles may then be aggregated to form aggregated toner particles. Optionally, a second latex emulsion of polymer particles may be added to the aggregated toner particles, which upon further aggregation forms a shell on the aggregated toner particles. The resulting aggregated toner particles may be heated in a batch or continuous process to allow coalescence/fusing to occur, thereby providing aggregated, fused toner particles with increased circularity.

Various hybrid toner particles have been prepared. However, there remains a need for hybrid toner particles and methods for their preparation for use in toners for high speed printing, particularly high speed monochrome printing that provides excellent flow, charging, lower toner usage, and reduced drum contamination.

Emulsion aggregation toners may comprise various resins for use in forming the latex. One type of emulsion aggregation toner provides high gloss and uses styrene-acrylate, a lower costing resin. Another type of emulsion aggregation toner provides better fusing performance (e.g., lower Minimum Fusing Temperature (MFT) of about 20° C.) and uses polyesters as the base resin. However, the polyester resins used are high in cost. Thus, the present embodiments seek to form a hybrid emulsion aggregation toner that combines the advantages from both types of toners. However, it was discovered that toners with styrene-acrylate latexes do not melt at the same temperature during the toner process as the polyester toners, thus leading to variation in the surface morphology in a hybrid of the two toner types, as varying amounts of polystyrene/acrylate remains inhomogenously on the surface when the shell is initially predominately polyester. This issue is complicated by the fact that some styrene-acrylate migrates to the surface from the core. Thus, the present embodiments seek to avoid these issues by providing a core that comprises substantially polyester or, in the alternative, polyester and styrene-acrylate, and forming a shell comprising styrene-acrylate, with no polyester, over the core. This hybrid toner composition thus provides a lower costing toner that retains good fusing performance and low dielectric loss. Moreover, the shell improves the surface morphology by eliminating the variation in melting between the polyester and styrene-acrylate on the surface.

SUMMARY

The present embodiments provide a method to produce toner comprising first aggregating at least one polyester latex, and at least one styrene acrylate latex, and optionally a wax dispersion, and optionally a pigment dispersion to form a core, wherein styrene acrylate latex particles are aggregated onto the core to form a shell, and further wherein the resulting aggregated particle is subjected to a continuous coalescence process, comprising: heating the aggregated particle to a first temperature beyond its glass transition temperature in a first heat exchanger to form a coalesced particles; quenching the coalesced particles to a second temperature below the glass transition temperature after a residence time; and recovering the quenched coalesced particles at an outlet; wherein the circularity of the aggregated particles is from about 0.900 to about 0.940, and the circularity of the particles in the coalesced particle slurry has increased to a value from about 0.940 to about 0.999 and further wherein the resulting toner comprises a hybrid composition with both styrene/acrylate and polyester.

[6] In specific embodiments, there is provided a toner composition, comprising: toner particles having a core; and a shell disposed over the core, wherein the core comprises at least a first polyester polymer and at least a first styrene acrylate polymer; and optionally a wax dispersion, and optionally a pigment dispersion, and further wherein the shell comprises substantially a second styrene acrylate polymer.

In yet other embodiments, there is provided a method of preparing a toner composition, comprising: forming toner particles having a core and a shell, wherein forming further comprises coalescing the toner particles by a continuous coalescence process, wherein the core includes at least one polyester polymer and at least one styrene acrylate polymer, and optionally a wax dispersion, and optionally a pigment dispersion; and further aggregating styrene acrylate latex particles onto the core to form a shell; wherein the toner particles have a fusing latitude of from about 100° C. to about 240° C.

BRIEF DESCRIPTION OF THE DRAWINGS

For a better understanding of the present embodiments, reference may be had to the accompanying figures.

DETAILED DESCRIPTION

Figure 1:
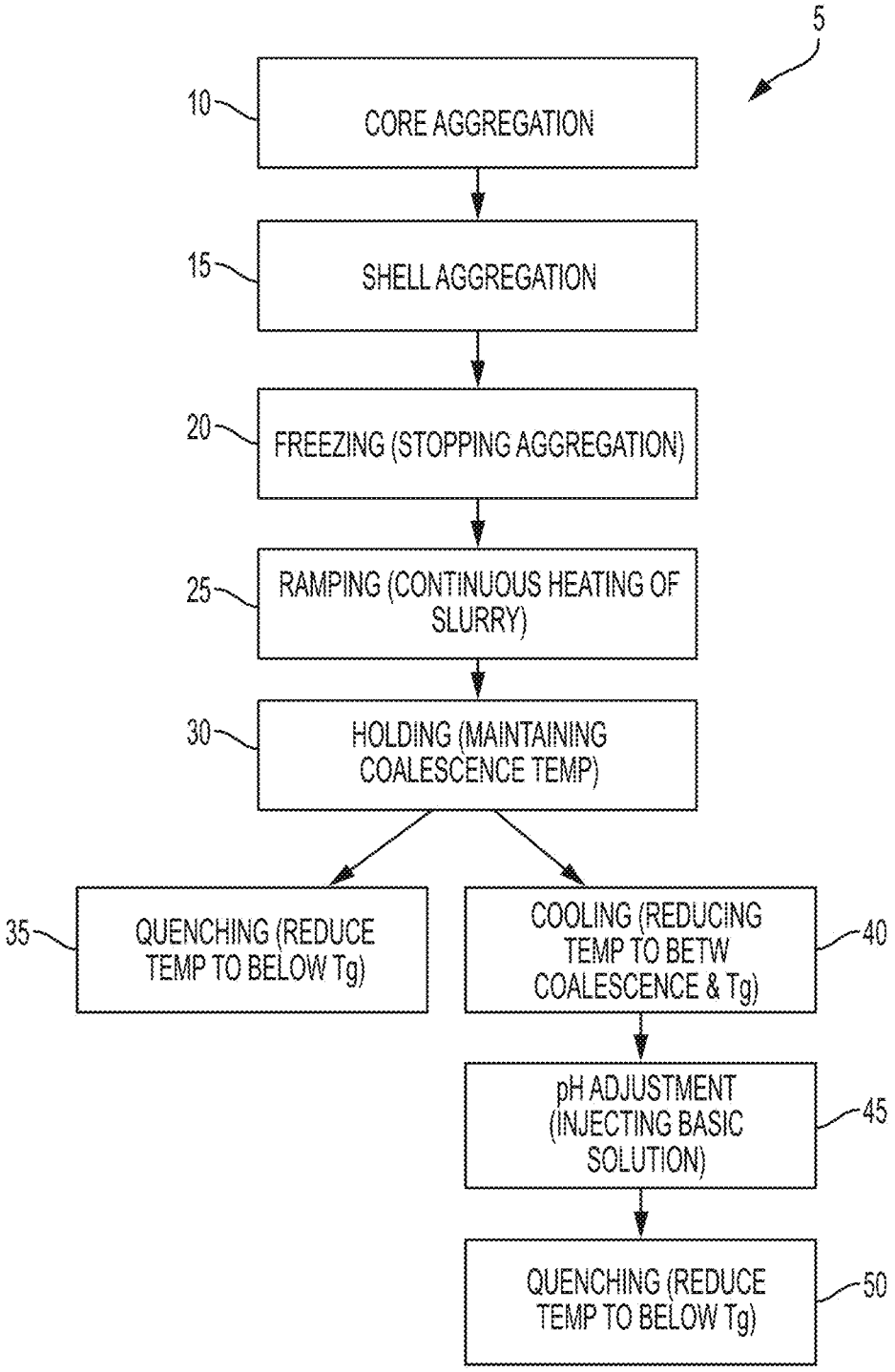
FIG. 1 illustrates a continuous coalescence process according to an embodiment herein.
Figure 2A:
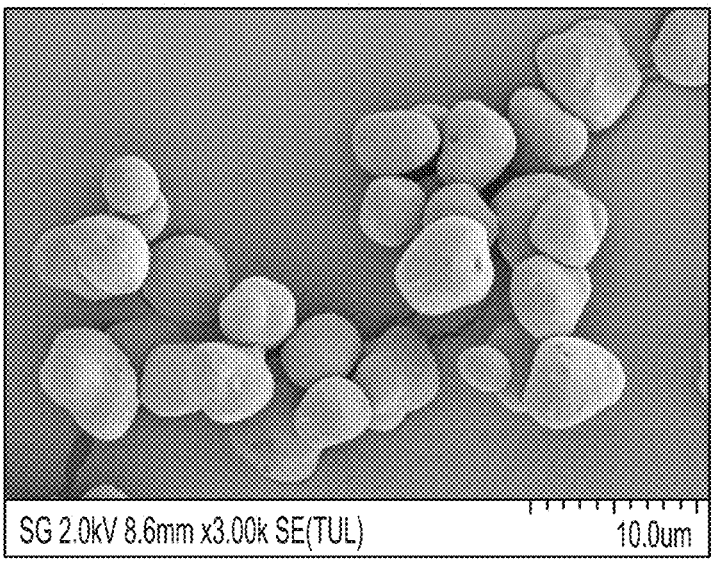
FIG. 2A provides scanning electron microscope (SEM) images of hybrid toner particles made by a continuous process according to the present embodiments (Example 3)
Figure 2B:
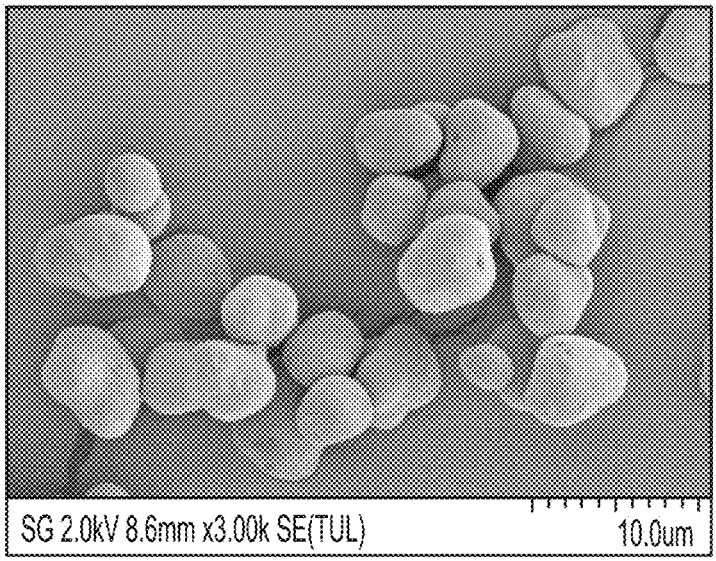
FIG. 2B provides magnified SEM images of hybrid toner particles made by a continuous process according to the present embodiments.
Figure 3A:
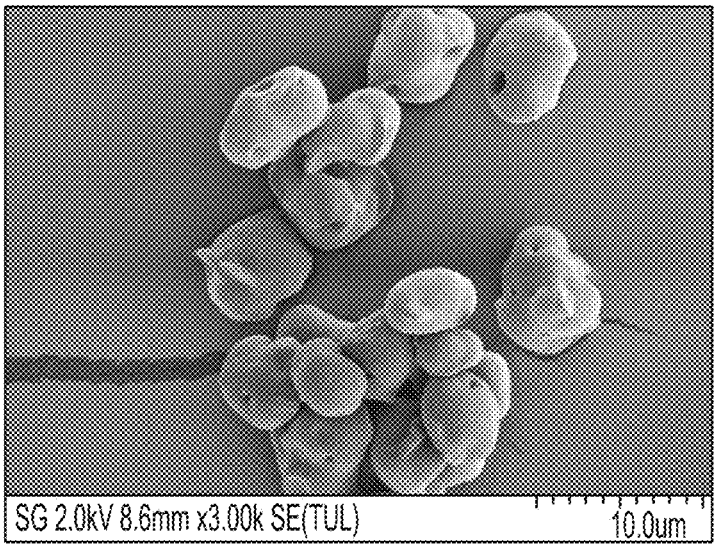
FIG. 3A provides SEM images of comparative toner particles made by a batch process (Comparative Example 5)
Figure 3B:
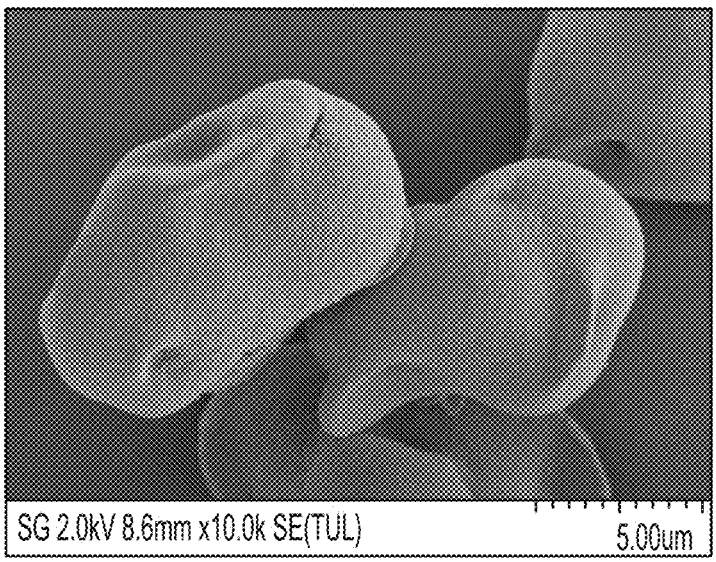
FIG. 3B provides magnified SEM images of comparative toner particles made by a batch process.
Figure 4:
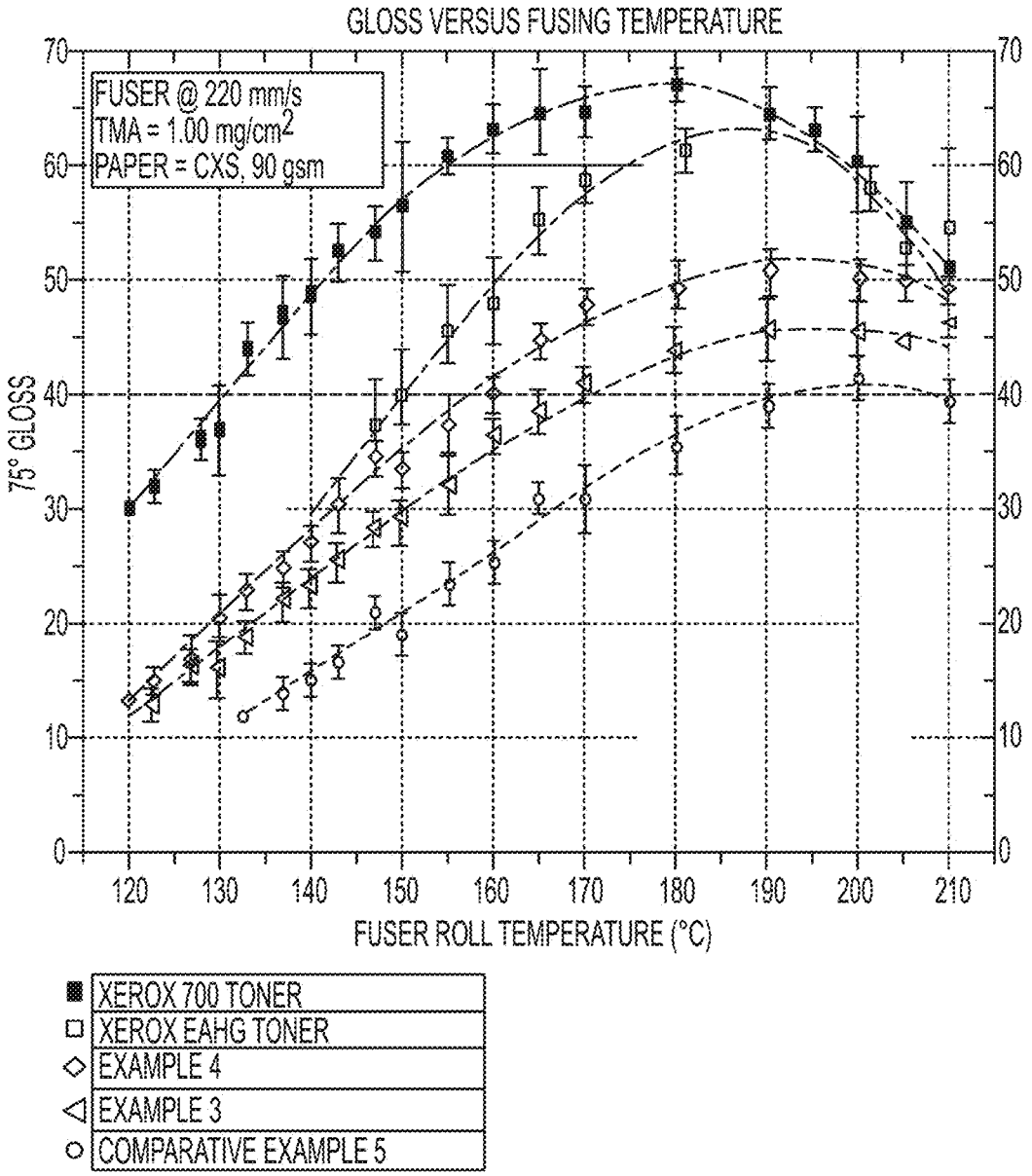
FIG. 4 is a graph illustrating gloss plots of Examples 3, 4 and 5.

The present disclosure relates to toners and processes useful in providing toners suitable for electrophotographic apparatuses, including apparatuses such as digital, image-on-image, and similar apparatuses. In particular, the disclosure relates to an emulsion aggregation toner that comprises toner particles having a core composed of either polyester resin or both styrene-acrylate and polyester resins. These embodiments also comprise a shell disposed over the core, wherein the shell comprises styrene-acrylate resin. Toners made in this manner exhibit good surface morphology and fusing performance. Further, such hybrid emulsion aggregation toner compositions are lower in cost but still maintain desirable developer properties like good charge relative humidity (RH) performance.

Hybrid Toner Particles

In embodiments herein, toner particles are referred to as "hybrid" because they are a mixture of two or more different polymers. The hybrid toner particles have a core/shell structure. According to certain embodiments, the core can be a mixture of one or more polyester polymers and one or more styrene acrylate polymers.

In embodiments, the shell comprises styrene acrylate polymers without any polyester polymers. Accordingly, in some embodiments, the shell can comprise substantially (greater than 50%) one or more styrene acrylate polymers. In other embodiments, the shell comprises from about 95 to about 100% by weight of one or more styrene acrylate polymers. In further embodiments, the shell contains exclusively styrene acrylate polymers.

In further embodiments, the polyester polymer(s) of the core can be the same or different. Likewise, the styrene acrylate polymer(s) of the core and shell can be the same or different.

The hybrid toner particles herein may also include other additives, for example, one or more colorants or pigments, one or more emulsifying agents or surfactants, one or more waxes, one or more aggregating agents, one or more coagulants, and/or one or more other optional additives. Any suitable emulsion aggregation procedure may be used and/or modified to prepare the hybrid toner particles of the present disclosure.

In embodiments, the hybrid toner particles may have a cold offset temperature of from about 100° C. to about 125° C., or from about 105° C. to about 120° C., or from about 110° C. to about 115° C.

In embodiments, the hybrid toner particles may have a hot offset temperature of from about 200° C. to about 240° C., or from about 205° C. to about 230° C., or from about 210° C. to about 220° C.

In embodiments, the hybrid toner particles may have a fusion latitude of from about 100° C. to about 240° C., or from about 110° C. to about 220° C., or from about 120° C. to about 210° C.

In embodiments, the hybrid toner particles, exclusive of surface additives, may have the following characteristics: (1) volume average diameter (also referred to as "volume average particle diameter") of from about 2.5 to about 20 μm, or from about 2.75 to about 10 μm, or from about 3 to about 7.5 μm; (2) number average geometric standard deviation (GSDn) of from about 1.10 to about 1.30, or from about 1.15 to about 1.25, or from about 1.20 to about 1.23; (3) volume average geometric standard deviation (GSDv) of from about 1.10 to about 1.30, or from about 1.15 to about 1.25, or from about 1.20 to about 1.23; and (4) circularity (measured with, for example, a Sysmex FPIA 2100 analyzer) of from about 0.9 to about 1.0, or from about 0.950 to about 0.985, or from about 0.960 to about 0.980, or about 0.975.

In embodiments, the hybrid toner particles may have a minimum fix temperature (MFT) of from about 100° C. to about 130° C., or from about 105° C. to about 125° C., or from about 110° C. to about 120° C.

In embodiments, the MFT for continuously coalesced (described below) hybrid toner particles herein having a core mixture of polyester polymer(s) and styrene acrylate polymer(s) and a shell of substantially styrene acrylate polymer(s) may be about 125° C.

A comparison of the continuously coalesced process and the batch coalesced process (described below) on material taken from the same batch of aggregated slurry of hybrid latex shows different MFT values for the resulting hybrid toner particles, according to embodiments herein. For example, in an embodiment, the MFT for continuously coalesced hybrid toner particles having a core mixture of polyester polymer(s) and styrene acrylate polymer(s) and a shell of substantially styrene acrylate polymer(s) may be about 126° C., whereas the MFT for batch coalesced hybrid toner particles with the same core/shell composition may be about 134° C. The eight degree difference in temperature for the MFT can be an advantage of using a continuous coalescing process over a batch coalescing process for preparing the hybrid toner particles.

Polyester Polymers

In embodiments, any polyester polymer(s) known in the art may be utilized in the disclosed embodiments to form the hybrid latex particles. For example, the polymer(s) may be an amorphous polyester polymer, a crystalline polyester polymer, and/or various combinations thereof.

In embodiments, the polyester polymer may be present in the toner particles herein, for example, in an amount of from about 5% to about 95% by weight of the resin, or from about 15% to about 85% by weight, or from about 25% to about 75% by weight.

In embodiments, the polyester polymer(s) may be present in the core of the hybrid toner particles in an amount of from about 5 weight % to about 95 weight %, or from about 15 weight % to about 85 weight %, or from about 25 weight % to about 75 weight %, or from about 30 weight % to about 70 weight %, or from about 40 weight % to about 60 weight %, or about 50 weight % of the core polymers.

Suitable amorphous polyester polymers include but are not limited to ethoxylated and propoxylated bis-phenol-A derived polyester polymers. Other suitable polymers include saturated or unsaturated amorphous polyester polymers; high molecular weight or low molecular weight amorphous polyester polymers; and bis-phenol-A derived amorphous polyester polymers. Other useful amorphous polyester polymers include those described in U.S. Pat. Nos. 8,192,913; 6,830,860; 6,756,176; 6,593,049; and 6,063,827; and U.S. Patent Application Publication Nos. 2013/0164668 and 2006/0222991, the disclosures of which are hereby incorporated by reference in their entireties. In addition, amorphous polyester polymers include those obtained from the reaction of bis-phenol-A and propylene oxide or propylene carbonate, followed by the reaction of the resulting product with fumaric acid as disclosed in U.S. Pat. No. 5,227,460, the disclosure of which is hereby incorporated by reference in its entirety.

In embodiments, a suitable amorphous polyester polymer may be based on any combination of propoxylated and/or ethoxylated bis-phenol-A, terephthalic acid, fumaric acid, and dodecenyl succinic anhydride. For example, the polyester polymer may have formula I:

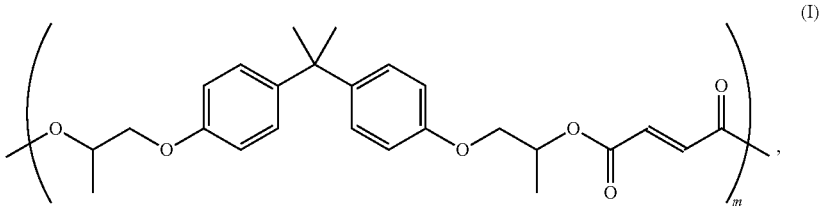

(I)

wherein may be from about 5 to about 1000.

In embodiments, propoxylated bis-phenol-A derived polyester polymers available from Kao Corporation, Japan, may be utilized. These polymers include acid groups and may be of low molecular weight or high molecular weight.

In embodiments, a high molecular weight amorphous polyester polymer may have a weight average molecular weight of from about 40,000 g/mol to about 150,000 g/mol, or from about 50,000 g/mol to about 140,000 g/mol, or from about 60,000 g/mol to about 125,000 g/mol of polymer. A low molecular weight amorphous polyester polymer may have a weight average molecular weight of from about 10,000 g/mol to about 40,000 g/mol, or from about 15,000 g/mol to about 30,000 g/mol, or from about 20,000 g/mol to about 25,000 g/mol of polymer.

In embodiments, the amorphous or crystalline polyester polymer may be formed by the polycondensation process of reacting a diol with a diacid in the presence of an optional catalyst.

Examples of diacid or diesters selected for the preparation of amorphous polyesters include dicarboxylic acids or diesters such as terephthalic acid, phthalic acid, isophthalic acid, furnaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethyl-isophthalate, diethylisophthalate, dimethylphthalate, phthalic anhydride, diethylphthalate, dimethylsuccinate, dimethylfumarate, dimethylmaleate, dimethyl-glutarate, dimethyladipate, dimethyl dodecylsuccinate, and combinations thereof. The organic diacid or diester may be selected, for example, from about 40 to about 60 mole percent of the polymer.

Examples of diols utilized in generating the amorphous polyester include 1,2-propanediol; 1,3-propanediol; 1,2-butanediol; 1,3-butanediol; 1,4-butanediol; pentanediol; hexanediol; 2,2-dimethylpropanediol; 2,2,3-trimethylhexanediol; heptanediol; dodecanediol; bis(hyroxyethyl)-bis-phenol-A; bis(2-hydroxypropyl)-bis-phenol-A; 1,4-cyclohexanedimethanol; 1,3-cyclohexanedimethanol; xylene-dimethanol; cyclohexane-diol; diethylene glycol; bis (2-hydroxyethyl) oxide; dipropylene glycol; dibutylene; and combinations thereof. The amount of organic diol selected may vary, and may be, for example, from about 40 to about 60 mole percent of the polymer.

Examples of other amorphous polymers which may be utilized include alkali sulfonated-polyester polymers and branched alkali sulfonated-polyester polymers. Alkali sulfonated polyester polymers may be useful in embodiments, such as the metal or alkali salts of copoly(ethylene-terephthalate)-copoly(ethylene-5-sulfo-isophthalate), copoly-(propylene-terephthalate)-copoly(propylene-5-sulfo-isophthalate), copoly-(di-ethylene-terephthalate)-copoly(di-ethylene-5-sulfo-isophthalate), copoly-(propyl-ene-di-ethylene-terephthalate)-copoly(propylene-diethylene-5-sulfoisophthalate) copoly-(propylene-butylene-terephthalate)-copoly(propylene-butylene-5-sulf-o-iso-phthalate), copoly-(propoxylated bisphenol-A-fumarate)-copoly(propoxylated bis-phenol-A-5-sulfo-iso-phthalate), copoly(ethoxylated bisphenol-A-fumarate)-copoly-(ethoxylated bis-phenol-A-5-sulfo-isophthalate), and copoly(ethoxylated bisphenol-A-maleate)-copoly-(ethoxylated bisphenol-A-5-sulfo-isophthalate), and wherein the alkali metal is, for example, a sodium, lithium or potassium ion.

For forming a crystalline polyester, suitable organic diols include aliphatic diols with from about 2 to about 36 carbon atoms, such as 1,2-ethanediol; 1,3-propanediol; 1,4-butanediol; 1,5-pentanediol; 1,6-hexanediol; 1,7-heptanediol; 1,8-octanediol; 1,9-nonanediol; 1,10-decanediol; 1,12-dodecanediol and the like; alkali sulfo-aliphatic diols such as sodium 2-sulfo-1,2-ethanediol; lithium 2-sulfo-1,2-ethanediol; potassium 2-sulfo-1,2-ethanediol; sodium 2-sulfo-1,3-propanediol; lithium 2-sulfo-1,3-propanediol; potassium 2-sulfo-1,3-propanediol; mixtures thereof; and the like. The aliphatic diol may be, for example, selected in an amount of from about 40 to about 60 mole percent of the polymer, and the alkali sulfo-aliphatic diol may be selected in an amount of from about 1 to about 10 mole percent of the polymer.

Examples of organic diacids or diesters selected for the preparation of the crystalline polymers include oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclo-hexane dicarboxylic acid, malonic acid and mesaconic acid, a diester or anhydride thereof; The organic diacid may be selected in an amount of, for example, from about 40 to about 60 mole percent, from about 42 to about 52 mole percent, or from about 45 to about 50 mole percent. and an alkali sulfo-organic diacid such as the sodium, lithium or potassium salt of dimethyl-5-sulfo-isophthalate; dialkyl-5-sulfo-isophthalate-4-sulfo-1,8-naphthalic anhydride; 4-sulfo-phthalic acid; dimethyl-4-sulfo-phthalate; dialkyl-4-sulfo-phthalate; 4-sulfophenyl-3,5-dicarbomethoxybenzene; 6-sulfo-2-naphthyl-3,5-dicarbomethoxybenzene; sulfo-terephthalic acid; dimethyl-sulfo-terephthalate; 5-sulfo-isophthalic acid; dialkyl-sulfoterephthalate; sulfoethanediol; 2-sulfopropane-diol; 2-sulfobutanediol; 3-sulfo-pentanediol; 2-sulfohexanediol; 3-sulfo-2-methyl-pentanediol; 2-sulfo-3,3-dimethyl-pentanediol; sulfo-p-hydroxybenzoic acid; N,N-bis(2-hydroxyethyl)-2-amino ethane sulfonate; or mixtures thereof. The organic diacid may be selected in an amount of, for example, from about 40 to about 60 mole percent of the polymer, and the alkali sulfo-aliphatic diacid may be selected in an amount of from about 1 to about 10 mole percent of the polymer.

Some specific crystalline polyester polymers may include poly(ethylene-adipate), poly(propylene-adipate), poly(butylene-adipate), poly(pentylene-adipate), poly-(hexylene-adipate), poly(octylene-adipate), poly(ethylene-succinate), poly-(propylene-succinate), poly(butylene-succinate), poly (pentylene-succinate), poly-(hexylene-succinate), poly(octylene-succinate), poly(ethylene-sebacate), poly-(propylene-sebacate), poly(butylene-sebacate), poly(pentylene-sebacate), poly-(hexylene-sebacate), poly(octylene-sebacate), alkali copoly(5-sulfoisophthaloyl)-copoly (ethylene-adipate), alkali copoly(5-sulfoisophthaloyl)-copoly(propylene-adipate), alkali copoly(5-sulfoisophthaloyl)-copoly(butylene-adipate), alkali copoly-(5-sulfo-isophthaloyl)-copoly-(pentylene-adipate), alkali copoly(5-sulfo-iso-phthaloyl)-copoly(hexylene-adipate), alkali copoly(5-sulfo-isophthaloyl)-copoly-(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly-(pentylene-adipate), alkali copoly(5-sulfo-iso-phthaloyl)-copoly(hexylene-adipate), alkali copoly(5-sulfo-isophthaloyl)-copoly-(octylene-adipate), alkali copoly(5-sulfo-isophthaloyl)-copoly(ethylene-succinate), alkali copoly(5-sulfoisophthaloyl)-copoly-(propylene-succinate), alkali copoly(5-sulfoiso-phthaloyl)-copoly(butylenes-succinate), alkali copoly(5-sulfoisophthaloyl)-copoly-(pentylene-succinate), alkali copoly(5-sulfoisophthaloyl)-copoly(hexylene-succinate), alkali copoly(5-sulfo-isophthaloyl)-copoly (octylene-succinate), alkali copoly(5-sulfo-isophthaloyl)-copoly-(ethylene-sebacate), alkali copoly(5-sulfo-iso-phthaloyl)-copoly(propylene-sebacate), alkali copoly(5-sulfo-isophthaloyl)-copoly-(butylene-sebacate), alkali copoly(5-sulfo-isophthaloyl)-copoly(pentylene-sebacate), alkali copoly-(5-sulfo-iso-phthaloyl)-copoly(hexylene-sebacate), alkali copoly-(5-sulfo-iso-phthaloyl)-copoly-(octylene-sebacate), alkali copoly(5-sulfo-isophthaloyl)-copoly-(ethylene-adipate), alkali copoly(5-sulfo-isophthaloyl)-copoly-(propylene-adipate), alkali copoly(5-sulfo-isophthaloyl)-poly(butylene-adipate), alkali copoly(5-sulfo-isophthaloyl)-copoly-(pentylene-adipate), alkali copoly(5-sulfo-isophthaloyl)-copoly-(hexylene-adipate), and poly (octylene-adipate), wherein alkali is a metal like sodium, lithium or potassium The crystalline polymer may have a melting point of, for example, from about 30° C. to about 120° C., or from about 50° C. to about 90° C. The crystalline polymer may have a number average molecular weight (Mn), as measured by gel permeation chromatography (GPC) of, for example, from about 1,000 to about 50,000, or from about 2,000 to about 25,000; and a weight average molecular weight (MW) of, for example, from about 2,000 to about 100,000, or from about 3,000 to about 80,000, as determined by gel permeation chromatography using polystyrene standards. The molecular weight distribution (MW/Mn) of the crystalline polymer may be, for example, from about 2 to about 6, or from about 2 to about 4.

Styrene Acrylate Polymers

In embodiments, any styrene acrylate polymer(s) known in the art may be utilized in the disclosed embodiments to form the hybrid latex particles. For convenience, the term "acrylic" will be used with the understanding that this term encompasses both the acrylic and methacrylic forms. Exemplary emulsion aggregation latex copolymers of styrene and acrylate are illustrated in U.S. Pat. No. 6,120,967, the disclosure of which is hereby incorporated by reference in its entirety.

In embodiments, the styrene acrylate polymer(s) may be present in the toner particles herein, for example, in an amount of from about 5% to about 95% by weight of the resin or from about 15% to about 85% by weight, or from about 25% to about 75% by weight.

In embodiments, the styrene acrylate polymer(s) may be present in the core of the hybrid toner particles in an amount of from about 5 weight % to about 95 weight %, or from about 10 weight % to about 90 weight %, or from about 20 weight % to about 80 weight %, or from about 30 weight % to about 70 weight %, or from about 40 weight % to about 60 weight % or about 50 weight % of the core polymers.

In embodiments, the styrene acrylate polymer(s) may be present in the shell of the hybrid toner particles in an amount of from about 95 weight % to about 100, or about 100 weight In embodiments, exemplary polymers include styrene acrylates and, more specifically, polymers of styrene alkyl substituted acrylates. In embodiments, the acrylate component may be a water-insoluble ethylenically unsaturated ester of acrylic acid with a C1 to C18 alcohol. Examples of such acrylates include but are not limited to methyl acrylate, ethyl acrylate, propyl acrylate, butyl acrylate, pentyl acrylate, hexyl acrylate, and the like.

In embodiments, non-polyester latex resins formed by emulsion polymerization may be used. Generally, the latex resin may be composed of a first and a second monomer composition. Any suitable monomer or mixture of monomers may be selected to prepare the first monomer composition and the second monomer composition. The selection of monomer or mixture of monomers for the first monomer composition is independent of that for the second monomer composition and vice versa. In case a mixture of monomers is used, typically the latex polymer will be a copolymer. As discussed above, the latex resin is composed of at least styrene acrylate, a polyester resin and a crystalline resin.

Exemplary monomers for the first and/or the second monomer compositions include, but are not limited to, polyesters, styrene, alkyl acrylate, such as, methyl acrylate, ethyl acrylate, butyl arylate, isobutyl acrylate, dodecyl acrylate, n-octyl acrylate, 2-chloroethyl acrylate; β-carboxy ethyl acrylate (β-CEA), phenyl acrylate, methyl alphachloroacrylate, methyl methacrylate, ethyl methacrylate and butyl methacrylate; butadiene; isoprene; methacrylonitrile; acrylonitrile; vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone and methyl isopropenyl ketone; vinylidene halides, such as, vinylidene chloride and vinylidene chlorofluoride; N-vinyl indole; N-vinyl pyrrolidone; methacrylate; acrylic acid; methacrylic acid; acrylamide; methacrylamide; vinylpyridine; vinylpyrrolidone; vinyl-N-methylpyridinium chloride; vinyl naphthalene; p-chlorostyrene; vinyl chloride; vinyl bromide; vinyl fluoride; ethylene; propylene; butylenes; isobutylene; and the like, and mixtures thereof.

In some embodiments, the first monomer composition and the second monomer composition may independently of each other comprise two or three or more different monomers (side note—sounds very similar to my entry above) The latex polymer therefore can comprise a copolymer. Illustrative examples of such a latex copolymer includes poly(styrene-n-butyl acrylate-β-CEA), poly(styrene-alkyl acrylate), poly (styrene-1,3-diene), poly(styrene-alkyl methacrylate), poly (alkyl methacrylate-alkyl acrylate), poly(alkyl methacrylate-aryl acrylate), poly(aryl methacrylate-alkyl acrylate), poly (alkyl methacrylate), poly(styrene-alkyl acrylate-acrylonitrile), poly(styrene-1,3-diene-acrylonitrile), poly (alkyl acrylate-acrylonitrile), poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylonitrile), poly(styrene-butyl acrylate-acrylononitrile), and the like.

In embodiments, the first monomer composition and the second monomer composition may be substantially water insoluble, such as, hydrophobic, and may be dispersed in an aqueous phase with adequate stirring when added to a reaction vessel.

The weight ratio between the first monomer composition and the second monomer composition may be in the range of from about 0.1:99.9 to about 50:50, including from about 0.5:99.5 to about 25:75, from about 1:99 to about 10:90.

In embodiments, the first monomer composition and the second monomer composition can be the same. Examples of the first/second monomer composition may be a mixture comprising styrene and alkyl acrylate, such as, a mixture comprising styrene, n-butyl acrylate and β-CEA. Based on total weight of the monomers, styrene may be present in an amount from about 1% to about 99%, from about 50% to about 95%, from about 70% to about 90%, although may be present in greater or lesser amounts; alkyl acrylate, such as, n-butyl acrylate, may be present in an amount from about 1% to about 99%, from about 5% to about 50%, from about 10% to about 30%, although may be present in greater or lesser amounts.

Initiators

Any suitable initiator or mixture of initiators may be selected in the latex process and the toner process. In embodiments, the initiator is selected from known free radical polymerization initiators. The free radical initiator can be any free radical polymerization initiator capable of initiating a free radical polymerization process and mixtures thereof, such free radical initiator being capable of providing free radical species on heating to above about 30° C.

Although water soluble free radical initiators are used in emulsion polymerization reactions, other free radical initiators also can be used. Examples of suitable free radical initiators include, but are not limited to, peroxides, such as, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, diisopropyl peroxycarbonate, tetralin hydroperoxide, 1-phenyl-2-methylpropyl-1-hydroperoxide and tert-butylhydroperoxide; pertriphenylacetate, tert-butyl performate; tert-butyl peracetate; tert-butyl perbenzoate; tert-butyl perphenylacetate; tert-butyl permethoxyacetate; ted-butyl per-N-(3-toluyl)carbamate; sodium persulfate; potassium persulfate, azo compounds, such as, 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)-nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1'-azobis-1,2-diphenylethane, poly(bisphenol A-4,4'-azobis-4-cyanopentano-ate) and poly(tetraethylene glycol-2,2'-azobisisobutyrate); 1,4-bis(pentaethylene)-2-tetrazene; 1,4-dimethoxycarbonyl-1,4-dipheny-l-2-tetrazene and the like; and mixtures thereof.

More typical free radical initiators include, but are not limited to, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, sodium persulfate, potassium persulfate, diisopropyl peroxycarbonate and the like.

Based on total weight of the monomers to be polymerized, the initiator may be present in an amount from about 0.1% to about 5%, from about 0.4% to about 4%, from about 0.5% to about 3%, although may be present in greater or lesser amounts.

A chain transfer agent optionally may be used to control the polymerization degree of the latex, and thereby control the molecular weight and molecular weight distribution of the product latexes of the latex process and/or the toner process according to the present disclosure. As can be appreciated, a chain transfer agent can become part of the latex polymer.

Chain Transfer Agent

In embodiments, the chain transfer agent has a carbon-sulfur covalent bond. The carbon-sulfur covalent bond has an absorption peak in a wave number region ranging from 500 to 800 cm-1 in an infrared absorption spectrum. When the chain transfer agent is incorporated into the latex and the toner made from the latex, the absorption peak may be changed, for example, to a wave number region of 400 to 4,000 cm-1.

Exemplary chain transfer agents include, but are not limited to, n-C3-15 alkylmercaptans, such as, n-propylmercaptan, n-butylmercaptan, n-amylmercaptan, n hexylmercaptan, n-heptylmercaptan, n-octylmercaptan, n-nonylmercaptan, n decylmercaptan and n-dodecylmercaptan; branched alkylmercaptans, such as, isopropylmercaptan, isobutylmercaptan, s-butylmercaptan, tert-butylmercaptan, cyclohexylmercaptan, tert-hexadecylmercaptan, tert-laurylmercaptan, tert nonylmercaptan, tert-octylmercaptan and tert-tetradecylmercaptan; aromatic ring containing mercaptans, such as, allylmercaptan, 3-phenylpropylmercaptan, phenylmercaptan and mercaptotriphenylmethane; and so on. The terms, mercaptan and thiol may be used interchangeably to mean C—SH group.

Examples of such chain transfer agents also include, but are not limited to, dodecanethiol, butanethiol, isooctyl-3-mercaptopropionate, 2-methyl-5-t-butyl-thiophenol, carbon tetrachloride, carbon tetrabromide and the like.

Based on total weight of the monomers to be polymerized, the chain transfer agent may be present in an amount from about 0.1% to about 7%, from about 0.5% to about 6%, from about 1.0% to about 5%, although may be present in greater or lesser amounts.

In embodiments, a branching agent optionally may be included in the first/second monomer composition to control the branching structure of the target latex. Exemplary branching agents include, but are not limited to, decanediol diacrylate (ADOD), trimethylolpropane, pentaerythritol, trimellitic acid, pyromellitic acid and mixtures thereof.

Based on total weight of the monomers to be polymerized, the branching agent may be present in an amount from about 0% to about 2%, from about 0.05% to about 1.0%, from about 0.1% to about 0.8%, although may be present in greater or lesser amounts.

In the latex process and toner process of the disclosure, emulsification may be done by any suitable process, such as, mixing at elevated temperature. For example, the emulsion mixture may be mixed in a homogenizer set at about 200 to about 400 rpm and at a temperature of from about 40° C. to about 80° C. for a period of from about 1 min to about 20 min.

Any type of reactor may be used without restriction. The reactor can include means for stirring the compositions therein, such as, an impeller. A reactor can include at least one impeller. For forming the latex and/or toner, the reactor can be operated throughout the process such that the impellers can operate at an effective mixing rate of about 10 to about 1,000 rpm.

Following completion of the monomer addition, the latex may be permitted to stabilize by maintaining the conditions for a period of time, for example for about 10 to about 300 min, before cooling. Optionally, the latex formed by the above process may be isolated by standard methods known in the art, for example, coagulation, dissolution and precipitation, filtering, washing, drying or the like.

The latex of the present disclosure may be selected for emulsion-aggregation-coalescence processes for forming toners, inks and developers by known methods. The latex of the present disclosure may be melt blended or otherwise mixed with various toner ingredients, such as, a wax dispersion, a coagulant, an optional silica, an optional charge enhancing additive or charge control additive, an optional surfactant, an optional emulsifier, an optional flow additive and the like. Optionally, the latex (e.g. around 40% solids) may be diluted to the desired solids loading (e.g. about 12 to about 15% by weight solids), before formulated in a toner composition.

Based on the total toner weight, the latex may be present in an amount from about 50% to about 100%, from about 60% to about 98%, from about 70% to about 95%, although may be present in greater or lesser amounts. Methods of producing such latex resins may be carried out as described in the disclosure of U.S. Pat. No. 7,524,602, herein incorporated by reference in entirety.

Neutralizing Agents

The acid groups present on the disclosed polyester and/or styrene acrylate polymers may be partially neutralized by the introduction of a neutralizing agent, such as a base solution, during neutralization (which occurs prior to aggregation of the hybrid latex particles). Suitable bases include but are not limited to ammonium hydroxide, potassium hydroxide, sodium hydroxide, sodium carbonate, sodium bicarbonate, lithium hydroxide, potassium carbonate, triethylamine, triethanolamine, pyridine and its derivatives, diphenylamine and its derivatives, poly(ethylene amine) and its derivatives, combinations thereof, and the like. After neutralization, the hydrophilicity, and thus the emulsifiability of the polymers, may be improved when compared with polymers that did not undergo such neutralization process.

Colorants

One or more colorants may be added to the slurry of hybrid latex particles, including but not limited to pigments, dyes, mixtures of pigments and dyes, mixtures of pigments, mixtures of dyes, and the like. The colorant may be, for example, carbon black, cyan, yellow, magenta, red, orange, brown, green, blue, violet or mixtures thereof.

The colorant may be present in the slurry of hybrid latex particles in an amount of from about 1% to about 25% by weight of solids (i.e. the slurry minus solvent), or from about 2% to about 15% by weight of solids, or from about 5% to about 10% by weight of solids.

Suitable colorants also include those colorants comprising carbon black, such as REGAL 330® and Nipex 35; magnetites, such as Mobay magnetites, MO8029™ and MO8060™; Columbian magnetites, such as MAPICO® BLACK; surface-treated magnetites; Pfizer magnetites, such as CB4799™, CB5300™, CB5600™ and MCX6369™; Bayer magnetites, such as BAYFERROX 8600™ and 8610™; Northern Pigments magnetites, such as NP604™ and NP608™; Magnox magnetites, such as TMB-100™ or TMB104™; and the like.

Colored pigments, such as cyan, magenta, orange, violet, brown, blue or mixtures thereof can be also be used, where the colored pigments exhibit a spectral response reflectance of R=0.20 or lower over the full spectral range, from about 400 to about 700 nm. The additional pigment or pigments may be used as water-based pigment dispersions.

Examples of suitable pigments include SUNSPERSE 6000, FLEXIVERSE and AQUATONE, water-based pigment dispersions from SUN Chemicals; HELIOGEN BLUE L6900™, D6840™, D7080™, D7020™, PYLAM OIL BLUE™, and PIGMENT BLUE I™ available from Paul Uhlich & Company, Inc.; PIGMENT VIOLET I™ available from Dominion Color Corporation, Ltd.; and the like.

Other known colorants may be used, such as Levanyl Black ASF (Miles, Bayer) and Sunsperse Carbon Black LHD 9303 (Sun Chemicals); and colored dyes, such as Neopen Blue (BASF), Sudan Blue OS (BASF), PV Fast Blue B2G 01 (American Hoechst), Sunsperse Blue BHD 6000 (Sun Chemicals), Irgalite Blue BCA (CibaGeigy), Paliogen Blue 6470 (BASF), Sudan Orange G (Aldrich), Sudan Orange 220 (BASF), Paliogen Orange 3040 (BASF), Ortho Orange OR 2673 (Paul Uhlich); combinations of the foregoing; and the like.

In some embodiments, portions of the pigment loading, for example furnace carbon black (e.g., Nipex 35), may be replaced by two or more second colorants or pigments that are not blacks. In certain embodiments, the pigment loading is increased by at least about 10%, or by at least about 20%, or by at least about 30% or more by replacing portions of the black with a set of color pigments that exhibit a spectral response that is substantially the same as carbon black and where such color pigments may be selected based on spectral response curve data.

In some embodiments, more than two colorants may be present in a toner particle. For example, three colorants may be present in a toner particle, such as a first colorant of pigment may be present in an amount ranging from about 1% to about 10% by weight, or from about 2% to about 8% by weight, or from about 3% to about 5% by weight of the toner particle on a solids basis; with a second colorant of pigment that may be present in an amount ranging of from about 1% to about 10% by weight, or from about 2% to about 8% by weight, or from about 3% to about 5% by weight of the toner particle on a solids basis; with a third colorant of pigment that may be present in an amount ranging of from about 1% to about 10% by weight, or from about 2% to about 8% by weight, or from about 3% to about 5% by weight of the toner particle on a solids basis.

Emulsifying Agents

One or more emulsifying agents or surfactants may be present in the slurry of hybrid latex particles, which may include any surfactant suitable for use in forming a latex. Surfactants which may be utilized during the emulsification stage in preparing latexes with the processes of the present disclosure include anionic, cationic, and/or nonionic surfactants.

Anionic surfactants which may be utilized include but are not limited to sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid, combinations thereof, and the like. Other suitable anionic surfactants include DOWFAX® 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be used. Anionic surfactants may be employed in any desired or effective amount, for example, at least about 0.01% by weight of total monomers used to prepare the latex polymer, at least about 0.1% by weight of total monomers used to prepare the latex polymer; and no more than about 10% by weight of total monomers used to prepare the latex polymer, no more than about 5% by weight of total monomers used to prepare the latex polymer, although the amount can be outside of those ranges.

Examples of nonionic surfactants include but are not limited to alcohols, acids and ethers, for example, polyvinyl alcohol, polyacrylic acid, methalose, methyl cellulose, ethyl cellulose, propyl cellulose, hydroxylethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, mixtures thereof, and the like.

Examples of cationic surfactants include but are not limited to ammonium compounds, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, and C12, C15, C17 trimethyl ammonium bromides, mixtures thereof, and the like. Other cationic surfactants include cetyl pyridinium bromide, halide salts of quaternized polyoxyethylalkylamines, dodecylbenzyl triethyl ammonium chloride, and the like, and mixtures thereof. The choice of particular surfactants or combinations thereof as well as the amounts of each to be used are within the purview of those skilled in the art.

Waxes

One or more waxes may be present in the aggregated particle slurry, which can be either a single type of wax or a mixture of two or more different types of waxes (hereinafter identified as, "a wax") as described herein. A wax can also be added to a toner formulation or to a developer formulation, for example, to improve particular toner properties, such as toner particle shape, charging, fusing characteristics, gloss, stripping, offset properties and the like. Alternatively, a combination of waxes can be added to provide multiple properties to a toner composition. A wax may be included as, for example, a fuser roll release agent. The wax may also be combined with the polymer forming composition for forming toner particles. When included, the wax may be present in an amount of, for example, from about 1 weight % to about 25 weight % of the toner particles, or from about 5 weight % to about 20 weight % of the toner particles, or from about 10 weight % to about 15 weight % of the toner particles.

Waxes that may be selected include waxes having, for example, a weight average molecular weight of from about 500 to about 20,000, or from about 1,000 to about 10,000, or from about 2,000 to about 8,000. Waxes that may be used include, for example, polyolefins, such as polyethylene, polypropylene and polybutene waxes, such as those that are commercially available, for example, POLYWAX™ polyethylene waxes from Baker Petrolite; wax emulsions available from Michaelman, Inc. or Daniels Products Co.; EPOLENE N15™ which is commercially available from Eastman Chemical Products, Inc.; VISCOL 550P™, a low weight average molecular weight polypropylene, available from Sanyo Kasei K.K.; plant-based waxes, such as carnauba wax, rice wax, candelilla wax, sumac wax and jojoba oil; animal-based waxes, such as beeswax; mineral-based waxes and petroleum-based waxes, such as montan wax, ozokerite, ceresin wax, paraffin wax, microcrystalline wax and Fischer-Tropsch waxes; ester waxes obtained from higher fatty acids and higher alcohols, such as stearyl stearate and behenyl behenate; ester waxes obtained from higher fatty acids and monovalent or multivalent lower alcohols, such as butyl stearate, propyl oleate, glyceride monostearate, glyceride distearate and pentaerythritol tetrabehenate; ester waxes obtained from higher fatty acids and multivalent alcohol multimers, such as diethyleneglycol monostearate, dipropyleneglycol distearate, diglyceryl distearate and triglyceryl tetrastearate; sorbitan higher fatty acid ester waxes, such as sorbitan monostearate; cholesterol higher fatty acid ester waxes, such as, cholesteryl stearate, and so on.

Examples of functionalized waxes that may be used include, for example, amines and amides, for example, AQUA SUPERSLIP 6550™ and SUPERSLIP 6530™ available from Micro Powder Inc.; fluorinated waxes, for example, POLYFLUO 190™ POLYFLUO 200™, POLYSILK 19™ and POLYSILK 14™ available from Micro Powder Inc.; mixed fluorinated amide waxes, for example, MICROSPERSION 19™ also available from Micro Powder Inc.; imides, esters, quaternary amines, carboxylic acids, acrylic polymer emulsions, for example, JONCRYL 74™, 89™, 130™, 537™ and 535™ available from SC Johnson Wax; and chlorinated polypropylenes and polyethylenes available from Allied Chemical, Petrolite Corp. and SC Johnson. Mixtures and combinations of the foregoing waxes also may be used in some embodiments.

Process for Preparing Toner Particles

Known emulsion aggregation procedure may be used and/or modified to prepare the hybrid toner particles of the present disclosure. In various embodiments, these procedures may include the steps of:

a) forming a slurry of hybrid latex particles by preparing a first emulsion containing a polyester polymer(s) and a styrene acrylate polymer(s), and optionally a colorant(s) or pigment(s), an emulsifying agent(s) (surfactants), a wax(es), an aggregating agent(s), a coagulant(s), and/or other optional additive(s);

b) aggregating the hybrid latex particles in the slurry to form aggregated hybrid latex particles;

c) adding a second emulsion containing one or more styrene acrylate polymer(s) (which may be the same or different than the first emulsion) to the aggregated hybrid latex particles, and further aggregating the particles to form a shell thereon;

d) coalescing the aggregated hybrid latex particles in a continuous coalescence process to form coalesced aggregated hybrid toner particles; and e) cooling and collecting the coalesced aggregated hybrid toner particles to provide hybrid toner particles suitable for use in a toner.

In embodiments, when using a continuous coalescence process, the coalesced aggregated hybrid toner particles have a core of a mixture of one or more polyester polymers and one or more styrene acrylate polymers, along with a shell that is substantially or exclusively of styrene acrylate polymers.

Continuous coalescence differs from batch coalescence mainly in the duration time of coalescence, which occurs on the order of minutes (<~3) for a continuous process compared to hours (~3 hours) for a batch process. This allows for the diffusion time to be reduced during coalescence as well as the use of higher temperatures without producing over-rounded particles (i.e., too high circularity).

As further described below, during the continuous coalescence process of the aggregated hybrid latex particles having a mixed core composition of a polyester polymer and a styrene acrylate polymer and a aggregated shell composition of substantially all or all styrene acrylate polymers, the styrene acrylate polymer from the core may be controllably diffused to the surface of the particles and coalesced to form hybrid toner particles with a core of polyester polymer/styrene acrylate polymer, along with a shell of styrene acrylate polymers.

The controlled diffusion can occur by heating a slurry of the aggregated hybrid toner particles for a set amount of time (residence time) above the glass transition temperature of the toner polymers, and quenching the slurry to below the glass transition temperature. During the heating process, the rate of the increase in temperature and the residence time of the slurry above the glass transition temperature may be used to control the amount of styrene acrylate polymer that diffuses from the core to the surface of the particles. In embodiments, the residence time may be from about 0.5 minutes to about 5 minutes, or from about 0.75 minutes to about 3 minutes, or from about 1 minute to about 2 minutes.

Following preparation of the above latex particle mixture, it can be desirable to form larger particles or aggregates, often sized in micrometers, of the smaller particles from the initial polymerization reaction, often sized in nanometers. An aggregating factor may be added to the mixture. Suitable aggregating factors include, for example, aqueous solutions of a divalent cation, a multivalent cation or a compound comprising same. In some embodiments, the aggregating factor can be an inorganic cationic coagulant, such as, for example, polyaluminum chloride (PAC), polyaluminum sulfosilicate (PASS), aluminum sulfate, zinc sulfate, magnesium sulfate, chlorides of magnesium, calcium, zinc, beryllium, aluminum, sodium, and other metal halides including monovalent and divalent halides. The aggregating factor may be present in an emulsion in an amount of from about 0.01 to about 10 weight %, or from about 0.05 to about 5 weight %, or from about 0.1 to about 3 weight % based on the total solids in the toner particle. The aggregating factor may also contain minor amounts of other components, for example, nitric acid.

The aggregating factor may be added to the mixture at a temperature that is below the glass transition temperature (Tg) of the polymer. The aggregating factor may be added to the mixture components to form a toner in an amount of, for example, from about 0.1 pph to about 1 pph, or from about 0.25 pph to about 0.75 pph, or about 0.5 pph of the reaction mixture.

To control aggregation of the latex particles, the aggregating factor may be metered into the mixture over time. For example, the factor may be added incrementally into the mixture over a period of from about 5 to about 240 minutes, or from about 30 to about 200 minutes. Addition of the aggregating factor also may be done while the mixture is maintained under stirred conditions, for example, of from about 50 rpm to about 1,000 rpm, or from about 100 rpm to about 500 rpm; and at a temperature that is below the glass transition temperature of the polymer, for example, of from about 30° C. to about 90° C., or from about 35° C. to about 70° C. The growth and shaping of the latex particles following addition of the aggregation factor may be accomplished under any suitable condition(s).

The latex particles may be permitted to aggregate until a predetermined desired particle size is obtained. Particle size may be monitored during the growth process. For example, samples may be taken during the growth process and analyzed, for example, with a COULTER COUNTER, for average particle size. The aggregation thus may proceed by maintaining the mixture, for example, at elevated temperature, or slowly raising the temperature, for example, of from about 40° C. to about 100° C. or from about 50° C. to about 90° C., and holding the mixture at that temperature for example, of from about 0.5 hours to about 6 hours, or from about hour 1 to about 5 hours, while maintaining stirring, to provide the desired aggregated latex particles. Once the predetermined desired latex particle size is attained, the growth process is halted. In particular embodiments, the latex particle size used in making these toner compositions is of from about 100 nm to 250 nm, or from about 150 nm to about 200 nm.

Once the desired final size of the latex particles or aggregates is achieved, the pH of the mixture may be adjusted with base to a value of from about 6 to about 10, or from about 6.2 to about 7. The adjustment of pH may be used to freeze, that is, to stop, latex particle growth. The base used to stop latex particle growth may be, for example, an alkali metal hydroxide, such as, for example, sodium hydroxide, potassium hydroxide, ammonium hydroxide, combinations thereof and the like, in some embodiments, EDTA may be added to assist adjusting the pH to the desired value. The base may be added in amounts of from about 2 to about 25% by weight or from about 4 to about 10% by weight of the mixture.

In some embodiments, a sequestering agent or chelating agent may be introduced during or after aggregation is complete to adjust pH and/or to sequester or to extract a metal complexing ion, such as aluminum, from the aggregation process. Thus, the sequestering, chelating or complexing agent used after aggregation is complete may comprise a complexing component, such as ethylenediaminetetraacetic acid (EDTA), gluconal, hydroxyl-2,2'iminodisuccinic acid (HIDS), dicarboxylmethyl glutamic acid (GLDA), methyl glycidyl diacetic acid (MGDA), hydroxy-diethyliminodiacetic acid (HIDA), sodium gluconate, potassium citrate, sodium citrate, nitrotriacetate salt, humic acid, fulvic acid; salts of EDTA, such as alkali metal salts of EDTA, tartaric acid, gluconic acid, oxalic acid, polyacrylates, sugar acrylates, citric acid, polyasparic acid, diethylenetriamine pentaacetate, 3-hydroxy-4-pyridinone, dopamine, eucalyptus, iminodisuccinic acid, ethylenediamine-disuccinate, polysaccharide, sodium ethylenedinitrilotetraacetate, thiamine pyrophosphate, farnesyl pyrophosphate, 2-aminoethylpyrophosphate, hydroxyl ethylidene-1,1-diphosphonic acid, aminotrimethylene phosphonic acid, diethylene triaminepentamethylene phosphonic acid, ethylenediamine tetramethylene phosphonic acid, and mixtures thereof.

For separate aggregation and coalescence stages, the aggregation process may be conducted under shearing conditions at an elevated temperature, for example, of from about 40° C. to about 90° C., or from about 45° C. to about 80° C., which may be below the glass transition temperature of the polymer.

In some embodiments, the aggregate latex particles may be of a size of less than about 3 μm, or from about 2 μm to about 6 μm, or from about 3 μm to about 5 μm.

Core-shell Structure

In some embodiments of the present method 5, after aggregation, but prior to coalescence, a resin coating may be applied to the aggregated particles to form a shell thereover in order to achieve particles having a core-shell structure with an approximate predetermined particle size 10, 15, as shown in FIG. 1. In embodiments, such particles having a core-shell structure may be subject to the continuous ramp and coalescence processes of the present disclosure in order to achieve the final toner particles.

The shell resin may be applied to the aggregated particles by any suitable method. In embodiments, the resins utilized to form the shell may be in an emulsion including any known surfactants. The emulsion possessing the resins may be combined with the aggregated particles described above so that the shell forms over the aggregated particles, such as aggregated particles having a particle size that is about equal to the initial predetermined desired particle size. In embodiments, the shell may have a thickness of up to about 5 microns, or of from about 0.1 microns to about 2 microns, in other embodiments, from about 0.3 microns to about 0.8 microns, over the formed aggregates.

formation of the shell over the aggregated particles may occur while heating to a temperature of from about 30° C. to about 80° C., or from about 35° C. to about 70° C. The formation of the shell may take place for a period of time of from about 5 minutes to about 10 hours, in embodiments from about 10 minutes to about 5 hours.

Freezing Aggregation

In some embodiments, once the desired size of the particles to be acted on by the continuous ramp and coalescence processes of the present disclosure is achieved, the pH of the mixture may be adjusted with a base to a value of from about 3 to about 10, or from about 5 to about 9. The adjustment of the pH may be utilized to freeze, that is to stop, toner growth 20. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

In embodiments, before the slurry is heated to a coalescence temperature, the temperature of the slurry may reach a predetermined pH adjustment temperature and the pH of the slurry may be reduced to a predetermined coalescence pH by adding an aqueous acid solution, such as HNO3¬ . Adjusting the pH to a predetermined coalescence pH may increase spheroidization and preserve particle size distribution by controlling circularity based on pH at high temperatures. Examples of these processes include those disclosed, for example, in U.S. Patent Application Publication No. 2011/0318685 to Vanbesien et al., the disclosure of which is totally incorporated herein by reference.

Coalescence

According to the methods 5 of the present disclosure, the coalescence step 25, 30 may be carried out by continuously passing a frozen and/or aggregated toner slurry through at least one heat exchanger, where the at least one heat exchanger has been heated to a temperature suitable for coalescence. For example, in embodiments, the at least one heat exchanger may be heated to a temperature of from about 100° C. to about 150° C., such as from about 110° C. to about 145° C., or from about 120° C. to about 140° C. During this step, the slurry may be maintained at the coalescence temperature 30.

Because the at least one heat exchanger may be heated to a temperature greater than the boiling point of water at atmospheric pressure, the system may be pressurized, such as to a pressure that is sufficient (at the temperature selected for the heat exchanger) to avoid boiling the water component of the toner slurry. Atmospheric pressure refers, for example, to a pressure of about 760 torr, or 1 atmosphere (atm). The term "pressurized" refers, for example, to a pressure of the heat exchanger system that is greater than atmospheric pressure, such as a pressure greater than about 1 atm, or greater than about 1.5 atm, or greater than about 2 atm.

In embodiments, the pressure may be maintained at any desired pressure, such as a pressure greater than the vapor pressure of water. In contrast to a coalescence step of a typical batch process, where the temperature is kept below the boiling point of water at atmospheric pressure (such as less than about 96° C.) so as to avoid evaporating the water component of the toner slurry and boiling off the water present in the batch reactor, the system according to the instant disclosure may be pressurized, and thus the temperature may be increased to temperatures above the atmospheric boiling point of water with minimal or no loss of water due to boiling of the water component of the toner slurry. For example, in embodiments, the system may be pressurized when the at least one heat exchanger is heated to a temperature of from about 100° C. to about 150° C., such as from about 120° C. to about 145° C., or from about 130° C. to about 140° C. Thus, in the processes of the present disclosure, the coalescence process to achieve the final toner-particle shape and morphology may be carried out at higher temperatures than typical batch processes.

As a result of these higher temperatures, the rate of spheroidization (coalescence) may be increased such that coalescence may be completed within a residence time on the order of minutes. For example, coalescence may be completed with a residence time at temperature of from about 1 second to about 15 minutes, such as from about 10 seconds to about 10 minutes, or from about 15 seconds to about 5 minutes, or from about 30 seconds to about 2 minutes. As used herein, "residence time at temperature" refers to the time the toner slurry spends at a target temperature, such as a temperature suitable for coalescence, after the toner slurry has been heated to the target temperature within a heat exchanger. In embodiments, the residence time at temperature may be different from the time the toner slurry spends within the heat exchanger. For example, in embodiments, the toner slurry may be heated to temperature within a heat exchanger, and then coalescence may be completed by flowing the slurry through an insulated length of tubing such that the temperature drop is minimized, and for a residence time of from about 1 second to about 15 minutes, such as from about 10 seconds to about 5 minutes, or from about 30 seconds to about 2 minutes. In embodiments, the toner slurry may reach temperature at the outlet of the heat exchanger. In embodiments, the toner slurry may reach temperature within the body of the heat exchanger.

Because the target spheroidization may be met by passing the frozen and/or aggregated toner slurry through the at least one heat exchanger with a residence time on the order of minutes, the throughput of the system may be dependent only on the size and temperature of the heat exchangers in the system. In contrast, batch processes are much longer, typically requiring hours (sometimes more than 10 hours) for the particles to reach the target spheroidization.

In embodiments, the frozen and/or aggregated toner slurry may be preheated, such as to a temperature greater than the glass transition temperature (Tg) of the resin, before the toner slurry is heated to coalescence temperature in the at least one heat exchanger. The temperature of the preheating may be greater than the glass transition temperature of the resin, but less than the coalescence temperature. For example, in embodiments, the temperature of the preheating may be at a temperature of from about 5° C. to about 30° C. greater than the glass transition temperature of the resin, such as from about 7.5° C. to about 25° C. greater than the glass transition temperature of the resin, or from about 10° C. to about 20° C. greater than the glass transition temperature of the resin. In some embodiments, the temperature of the preheating may be a temperature of from about (Tg+5° C.) to about (Tg+30° C.), such as from about (Tg+7.5° C.) to about (Tg+25° C.), or from about (Tg+10° C.) to about (Tg+20° C.). For example, the toner slurry may be heated to a temperature greater than about 60° C., such as from about 60° C. to about 110° C., or from about 63° C. to about 85° C., or from about 65° C. to about 75° C. In embodiments, for example, the toner slurry may be preheated to about 65° C.

In embodiments, the frozen and/or aggregated toner slurry may be preheated to a temperature greater than the glass transition temperature of the resin before the toner slurry is added to the heat exchanger system. For example, the toner slurry may be preheated to a temperature greater than the glass transition temperature of the resin as a batch process in the aggregation vessel, or in a second vessel, before introducing the toner slurry to the heat exchanger system to continuously coalesce the particles. Pre-heating the slurry in the aggregation vessel prior to adding the slurry to the heat exchanger system eliminates the need for an additional piece of reaction equipment to carry out the preheating step.

By heating the toner slurry to a temperature greater than the glass transition temperature of the resin before introducing the toner slurry to the heat exchanger system, the continuous coalescence process has a minimal impact on fines particle generation, which prevents a change in the geometric size distribution (GSD) of the toner. The term "fines" refers, for example, to toner particles having less than about 3 μm volume median diameter. Without being limited to a particular theory, by heating the slurry beyond the glass transition temperature of the resin, the weakly aggregated toner particles may fuse together, making them more robust against temperature shock from the rate of heating in the heat exchanger. Thus, when the slurry is heated to a temperature greater than the glass transition temperature of the resin in a batch process before the slurry is introduced into the heat exchanger system to continuously coalesce the particles, the system produces less fines.

The preheated toner slurry may be introduced to the heat exchanger system immediately after it is heated to a temperature greater than the glass transition temperature of the resin, or it may be cooled and/or stored before being introduced into the heat exchanger system. Once the toner slurry, such as a frozen and aggregated toner slurry, has been preheated, it may be added to the heat exchanger system at a temperature greater or less than the glass transition temperature of the resin. In other words, if the toner slurry, such as a frozen and aggregated toner slurry, has once been preheated to a temperature greater than the glass transition temperature of the resin, the toner slurry may be introduced to the heat exchanger system at a temperature less than the glass transition temperature of the resin without the generation of fines—that is, a toner slurry that has been cooled need not be reheated before being introduced into the heat exchanger system to avoid the generation of fines.

In embodiments, the toner slurry may be preheated, such as to a temperature greater than the glass transition temperature of the resin, after being introduced to the heat exchanger system. In other words, the frozen and/or aggregated toner slurry may be preheated by passing the toner slurry through at least one heat exchanger heated to a temperature greater than the glass transition temperature of the resin but less than the coalescence temperature. For example, in embodiments, the toner slurry may be passed through a heat exchanger system comprising at least two heat exchangers, where the first heat exchanger and the second heat exchanger are heated to different temperatures.

In embodiments, the first heat exchanger may be heated to a temperature greater than the glass transition temperature of the resin, but less than the coalescence temperature, to preheat the toner slurry to a temperature greater than the Tg of the resin. In embodiments, the first heat exchanger may be heated to a temperature of from about (Tg+5° C.) to about (Tg+30° C.), such as from about (Tg+7.5° C.) to about (Tg+25° C.), or from about (Tg+10° C.) to about (Tg+20° C.). For example, the first heat exchanger may be heated to a temperature of greater than about 60° C., such as from about 60° C. to about 110° C., or from about 63° C. to about 100° C., or from about 65° C. to about 75° C. The second heat exchanger may be heated to a temperature suitable for coalescence. For example, in embodiments, the second heat exchanger may be heated to a temperature of from about 100° C. to about 150° C., such as from about 110° C. to about 145° C., or from about 120° C. to about 140° C. The first heat exchanger preheats the toner slurry to a temperature greater than the glass transition temperature of the resin, which prevents the large generation of fines.

In embodiments, the step of preheating the toner slurry may serve to decrease temperature shock on the slurry when it passes through the second (higher temperature) heat exchanger. Preheating in the first heat exchanger may also allow for some partial coalescence in the first heat exchanger. In embodiments this partial coalescence in the first heat exchanger may represent 2% to 20% of the coalescence process, or 5% to 15% of the coalescence process. For example, in embodiments, the partial coalescence in the first heat exchanger may result in the particles that may have a mean circularity of from about 0.88 to about 0.94, such as from about 0.89 to about 0.93, or from about 0.90 to about 0.93. Such particles may then be further processed in subsequent heat exchangers to obtain the toner particles having a mean circularity of from about 0.930 to about 0.990, such as from about 0.940 to about 0.985, or from about 0.945 to about 0.980. This initial fusing may yield more robust toner particles after the particles pass through the higher-temperature heat exchanger, thereby preventing the large generation of fines.

The toner slurry may be passed through more than one heat exchanger during the ramp and coalescence process 25, 30. For example, the toner slurry may be passed through at least two heat exchangers. In embodiments, the two heat exchangers may be heated to different temperatures. In embodiments, a first heat exchanger may be at a lower temperature than a second heat exchanger, such as in the preheating step discussed above. In embodiments, the toner may pass through at least two heat exchangers, where a first heat exchanger may be at a higher temperature than a second heat exchanger. For example, in embodiments, the first heat exchanger may be heated to a temperature of from about 100° C. to about 150°

C., such as from about 110° C. to about 145° C., or from about 120° C. to about 140° C. The second heat exchanger may be at a lower temperature than the first heat exchanger, such that the second heat exchanger quenches the temperature of the toner slurry after it exits the higher temperature heat exchanger. In embodiments, the second heat exchanger may reduce the temperature of the toner slurry to a temperature suitable for pH adjustment. For example, the second heat exchanger may reduce the temperature of the toner slurry in a range of from about 40° C. to about 90° C. below the coalescence temperature, such as from about 45° C. to about 80° C. lower than the coalescence temperature, or from about 50° C. to about 70° C. lower than the coalescence temperature. In embodiments, the temperature may be quenched to a temperature suitable for discharge 35, which in embodiments may be a temperature lower than the glass transition temperature (Tg) of the toner. In embodiments, domestic cold water may be used to maintain the heat exchangers at a lower temperature, such as from about 5 to about 20 or from about 7 to about 15 or specifically, about 10° C.

In embodiments, the toner slurry may be passed through more than one heat exchanger maintained at the same temperature. For example, two or more heat exchangers may be connected in series and heated to the same temperature on the shell side of the heat exchangers, such as with the same heating utility, such that the two or more heat exchangers may function as a single, longer heat exchanger.

In a heat exchanger system comprising at least one heat exchanger, the residence time within any single heat exchanger may be from about 0.1 minute to about 30 minutes, such as from about 1 minute to about 15 minutes, or from about 3 minutes to about 10 minutes. The total residence time of the toner in a heat exchanger system comprising at least one heat exchanger is the sum of the residence times of the individual heat exchangers in the system. Thus, the total residence time of the toner in the heat exchanger system depends on the number of heat exchangers in the system, and the temperature of each heat exchanger. In the present methods, the entire coalescence process is conducted continuously from about 0.5 minutes to about 5 minutes, or from about 0.75 minutes to about 3 minutes, or from about 1 minute to about 2 minutes.

Additionally, in embodiments, a system of heat exchangers may be connected in such a way that energy may be recovered from the ramp and coalescence step, thereby yielding greater energy efficiency in the process. For example, in embodiments, the system may comprise at least three heat exchangers, wherein the first and third heat exchangers are connected in a closed loop, and the second heat exchanger may be heated to a temperature suitable for coalescence. The first heat exchanger may preheat the incoming toner slurry prior to the slurry passing through the second (higher temperature) heat exchanger, and the third heat exchanger may cool the toner slurry after it passes through the second (higher temperature) heat exchanger. For example, in embodiments, the first heat exchanger may increase the temperature of the toner slurry from its initial temperature to a temperature of from about 51° C. to about 95° C., such as from about 51° C. to about 85° C., or from about 60° C. to about 79° C. The second heat exchanger may be heated to a temperature of from about 100° C. to about 150° C., such as from about 110° C. to about 145° C., or from about 120° C. to about 140° C. The third heat exchanger, which may be connected in a closed loop with the first heat exchanger, may cool the toner slurry to a temperature of from about 60° C. to about 100° C., such as from about 70° C. to about 90° C., or from about 75° C. to about 85° C., after the toner slurry exits the second heat exchanger. In embodiments where the first and third heat exchangers are connected in a closed loop, energy that is input into the system to heat the toner slurry may be recovered. In contrast, in batch processes, it is very difficult to recover energy from the ramping of toner to coalescence temperatures owing to the limitation of how efficiently energy may be stored over time scales associated with batch-batch cycles.

In embodiments, the process steps of the continuous process for coalescing particles may include heating at least one heat exchanger to a temperature suitable for coalescence, and passing the toner slurry, such as a frozen and aggregated toner slurry, through the at least one heat exchanger to coalesce the particles. In embodiments, the system is pressurized, such that an average pressure may be maintained, for example, at value greater than the vapor pressure of water. In such a pressurized system, the temperature may be increased to temperatures above the atmospheric boiling point of water without boiling the water component of the toner slurry.

For example, in embodiments, the at least one heat exchanger may be heated to a temperature of from about 100° C. to about 150° C., such as from about 110° C. to about 145° C., or from about 120° C. to about 140° C. In embodiments, the methods of the present disclosure may include a heat exchanger system where one or more parts of the system, or the entire system, may be pressurized. For example, the pressure of one or more of the heat exchangers of the system and/or the entire system may be maintained at a pressure greater than the vapor pressure of water. In embodiments, the pressure of one or more of the heat exchangers of the system and/or the entire system may be maintained at a predetermined temperature and pressure where the pressure may be from about 1% to about 800% greater than the vapor pressure of water (at the predetermined temperature), such as from about 1% to about 20% greater, or from about 5% to about 10% greater, or from about 10% to about 30% greater than the vapor pressure of water (at the predetermined temperature), or from about 15% to about 25% greater than the vapor pressure of water (at the predetermined temperature). In embodiments, for a given temperature, the pressure of one or more of the heat exchangers of the system and/or the entire system may be about 10% greater than the vapor pressure of water.

In embodiments, the temperature and pressure of the one or more of the heat exchangers of the system and/or the entire system are set to prevent the water component of the toner slurry from boiling. For example, at elevated pressures above one atm, one or more of the heat exchangers of the system and/or the entire system may be heated to temperatures above the boiling point of water at atmospheric pressure (for example above about 100° C., or in a range of from about 100° C. to about 200° C.). Because one or more of the heat exchangers of the system and/or the entire system is pressurized, the toner slurry may be heated to temperatures above the atmospheric boiling point of water without boiling the water component of the toner slurry. In embodiments, the pressure of the system may be maintained at a predetermined pressure by a back pressure regulator, a peristaltic pump, a gear pump, or a progressive cavity pump. In embodiments, the system may maintain a predetermined pressure by discharging through a back-pressure regulating diaphragm valve, which allows for discharge to the atmosphere.

In the methods of the present disclosure the slurry may ramped to a predetermined coalescence temperature 25, and the temperature of the slurry may be maintained at substantially that temperature that allows the particles to coalesce 30. In embodiments, high temperatures, such as from about 100° C. to about 150° C., or from about 110° C. to about 145° C., or from about 120° C. to about 140° C., may be used in one or more of the pressurized heat exchangers of the system to increase the rate of spheroidization such that coalescence may be completed within a residence time on the order of minutes. For example, residence time of the slurry from about 1 second to about 15 minutes, such as from about 15 seconds to about 5 minutes, or from about 30 seconds to about 2 minutes in one or more of the pressurized high-temperature heat exchangers of the system of the present disclosure may be sufficient to achieve the desired coalescence and target spheroidization. In embodiments, a residence time of the slurry in one or more of the pressurized high-temperature heat exchangers of the system of the present disclosure of less than about 2 minutes may be sufficient to achieve the desired coalescence and target spheroidization.

Because the target spheroidization may be met by passing toner slurry, such as a frozen and aggregated toner slurry, through the at least one heat exchanger with a residence time on the order of minutes, throughput of the system is dependent only on the size and temperature of the heat exchanger. In embodiments, coalescence may take place entirely within one or more heat exchanger(s); that is to say, the toner slurry, such as a frozen and aggregated toner slurry, is continuously added to the one or more heat exchanger(s), and fully coalesced particles having a target degree of spheroidization may be recovered continuously from the one or more heat exchanger(s).

The coalesced particles may be measured periodically for circularity, such as with a Sysmex FPIA 3000 analyzer, where circularity of the particle may be described by the following formula:

$$\text{Circularity} = \frac{\text{Circularity of a circle having the same area as the particle}}{\text{Perimeter of the particle}}$$

A circularity of 1.000 indicates a completely circular sphere. In embodiments, the toner particles produced by the method of the present disclosure may have a mean circularity of from about 0.930 to about 0.990, such as from about 0.940 to about 0.985, or from about 0.945 to about 0.980. In embodiments, the target mean circularity may be reached with a residence time at temperature of from about 1 second to about 15 minutes, such as from about 10 seconds to about 10 minutes, or from about 15 seconds to about 5 minutes, or from about 30 seconds to about 2 minutes.

In embodiments, the at least one heat exchanger is a standard shell-tube heat exchanger. In embodiments, the shell-side of the heat exchanger may be exposed to a bath having a desired temperature, so as to heat or cool the heat exchanger to the desired temperature. For example, in embodiments, the bath may be a heated bath to increase the temperature of the at least one heat exchanger. In embodiments, the bath is an oil bath, such as a glycol bath or a glycol/water mixture bath.

In embodiments, a single heat exchanger may be used to conduct the coalescence step. In further embodiments, the toner slurry may be passed through more than one heat exchanger during the ramp and coalescence process. For example, in embodiments, the toner slurry may be passed through at least two heat exchangers.

For example, in embodiments, the slurry may be passed through at least one heat exchanger to ramp and coalesce the particles at a desired coalescence temperature, as described above, and then the slurry may be passed through at least one additional heat exchanger to quench the temperature of the slurry after coalescence 35. After coalescence, the mixture may be cooled to room temperature, such as a temperature from about 20° C. to about 25° C. The cooling may be rapid or slow, as desired. A suitable cooling method may include introducing cold water to a jacket around at least one additional heat exchanger to quench. After cooling, the toner particles may be optionally washed with water, and then dried. Drying may be accomplished by any suitable method for drying including, for example, freeze-drying.

The cooling process may include an additional pH adjustment at a predetermined cooling pH temperature. For example, in embodiments, at least one additional heat exchanger may quench the temperature of the toner slurry from the coalescence temperature to a pH adjustment temperature 40. The predetermined cooling pH adjustment temperature may be in a range of from about 40° C. to about 90° C. below the predetermined coalescence temperature, such as from about 45° C. to about 80° C., or from about 50° C. to about 70° C. below the predetermined coalescence temperature. The pH of the slurry may be adjusted to a predetermined cooling pH of from about 7.0 to about 10, such as from about 7.5 to about 9.5, or from about 8.0 to about 9.0. This may be done by adding an aqueous base solution, such as, for example, NaOH 45. The temperature of the slurry may be maintained at the predetermined cooling pH adjustment temperature for any time period, such as a time period of from about 0 minutes to about 60 minutes, or about 5 to about 30 minutes, followed by cooling to room temperature. In embodiments, the system may further contain at least one additional heat exchanger to further quench the temperature of the toner slurry from the pH adjustment temperature to a temperature suitable for discharge 50, such as room temperature.

The ramp and coalescence process may also be carried out in more than one heat exchanger. For example, the toner slurry may be passed through at least two heat exchangers. The first of the at least two heat exchangers may be maintained at a lower temperature than the second of the at least two heat exchangers. For example, the first heat exchanger may be heated to a temperature of from about 100° C. to about 115° C., such as from about 103° C. to about 110° C., or from about 105° C. to about 108° C. Accordingly, when the toner slurry, such as a frozen and aggregated toner slurry, is passed through this first heat exchanger, the first heat exchanger may increase the temperature of the toner slurry from its initial temperature (in embodiments, about 50° C.) to a temperature of from about 85° C. to about 110° C., such as from about 90° C. to about 100° C., or from about 92° C. to about 97° C. The second of the at least two heat exchangers may be heated to a temperature greater than that of the first heat exchanger. For example, the second heat exchanger may be heated to a temperature of from about 115° C. to about 150° C., such as from about 120° C. to about 145° C., or from about 130° C. to about 140° C.

In embodiments, the lower temperature heat exchanger may preheat the toner slurry before it reaches the second heat exchanger, which decreases the temperature shock on the incoming slurry when it passes through the higher temperature heat exchanger. Further, by heating the slurry from an initial temperature (such as about 51° C.) to the predetermined coalescence temperature (for example, about 130° C.) in two heat exchangers, the rate of temperature increase (° C./min) may be decreased as desired, such as decreasing the rate of temperature increase (° C./min) by half. Passing the toner slurry through the lower temperature heat exchanger before passing through the higher temperature heat exchanger also allows for some partial coalescence (partial aggregate fusing) in the first heat exchanger. This initial fusing yields more robust final toner particles after the toner slurry has passed through the second heat exchanger, thereby preventing the large generation of fines.

In embodiments, in addition to the above-described at least two heat exchangers, the system may contain at least one additional heat exchanger to quench the temperature of the toner slurry after it exits the second (higher temperature) heat exchanger. In embodiments, at least one heat exchanger may quench the temperature of the toner slurry from the coalescence temperature to a pH adjustment temperature. The at least one heat exchanger may reduce the temperature in a range of from about 40° C. to about 90° C. below the coalescence temperature, such as from about 45° C. to about 80° C., or from about 50° C. to about 70° C. below the coalescence temperature. The pH may then be adjusted by adding an aqueous base solution, such as, for example, NaOH. In embodiments, the pH may be adjusted in line. In embodiments, the system may further contain at least one additional heat exchanger to further quench the temperature of the toner slurry from the pH adjustment temperature to a temperature suitable for discharge. In embodiments, a temperature suitable for discharge is a temperature lower than the glass transition temperature (Tg) of the toner.

In embodiments, the total residence time of the toner slurry in each heat exchanger is from about 1 second to about 15 minutes, such as from about 10 seconds to about 10 minutes, or from about 15 seconds to about 5 minutes, or from about 30 seconds to about 2 minutes. Thereafter, the coalesced particles may be recovered from the system outlet.

In embodiments, the method may include passing toner slurry, such as a frozen and aggregated toner slurry, through at least three heat exchangers, wherein at least two heat exchangers are connected to recover energy from the ramp and coalescence process. For example, in embodiments, toner slurry, such as a frozen and aggregated toner slurry, may be passed through at least three heat exchangers, wherein the first and third heat exchangers are connected in a closed loop, and the second heat exchanger is heated to a temperature suitable for coalescence. In embodiments, the second heat exchanger may be heated to a temperature of from about 115° C. to about 150° C., such as from about 120° C. to about 145° C., or from about 130° C. to about 140° C. The third heat exchanger may cool the toner slurry after coalescence and recover heat energy added to the toner slurry in the second heat exchanger. Because the first and third heat exchangers are connected in a closed loop, this recovered heat energy can be used in the first heat exchanger to preheat the toner mixture before it passes through the second heat exchanger. Therefore, in embodiments, the first heat exchanger may increase the temperature of the toner slurry from its initial temperature (in embodiments, about 50° C.) to a temperature of from about 51° C. to about 99° C., such as from about 51° C. to about 85° C., or from about 60° C. to about 79° C. The second heat exchanger may then heat the toner slurry to a temperature of from about 100° C. to about 150° C., such as from about 110° C. to about 145° C., or from about 120° C. to about 140° C. The third heat exchanger may then cool the toner slurry to a temperature of from about 60° C. to about 100° C., such as from about 70° C. to about 90° C., or from about 75° C. to about 85° C. In embodiments, the system may be pressurized.

In producing toner particles, it is desirable to control the toner particle size and limit the amount of both fine and coarse toner particles in the toner. In embodiments, the toner particles have a very narrow particle size distribution with a lower geometric standard deviation (GSDn) by number of approximately 1.15 to approximately 1.30, such as approximately less than about 1.25. The toner particles also may have a size such that the upper geometric standard deviation (GSDv) by volume is in the range of from about 1.15 to about 1.30, such as from about 1.18 to about 1.22, or less than about 1.25.

The characteristics of the toner particles may be determined by any suitable technique and apparatus. Volume average particle diameter D50v, GSDv, and GSDn may be measured by means of a measuring instrument such as a Beckman Coulter Multisizer 3, operated in accordance with the manufacturer's instructions. The GSDv refers to the upper geometric standard deviation (GSDv) by volume (coarse level) for (D84/D50). The GSDn refers to the geometric standard deviation (GSDn) by number (fines level) for (D50/D16). The particle diameters at which a cumulative percentage of 50% of the total toner particles are attained is defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). These aforementioned number average particle size distribution indexes GSDn can be expressed by using D50 and D16 in cumulative distribution, wherein the number average particle size distribution index GSDn is expressed as (number D50/number D16). The closer to 1.0 that the GSD value is, the less size dispersion there is among the particles. The aforementioned GSD value for the toner particles indicates that the toner particles are made to have a narrow particle size distribution.

Suitable emulsion aggregation/coalescing processes for the preparation of toners, and which can be modified to include the ramp and coalescence processes as described in the present disclosure, are illustrated in U.S. Pat. Nos. 5,290,654, 5,278,020, 5,308,734, 5,370,963, 5,344,738, 5,403,693, 5,418,108, 5,364,729, and 5,346,797, the entire disclosures of the above-mentioned U.S. patents are totally incorporated herein by reference. Further processes, components and compositions that may be used with the processes of the present disclosure may include those described in U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; 5,977,210, 6,627,373; 6,656,657; 6,617,092; 6,638,677; 6,576,389; 6,664,017; 6,656,658; and 6,673,505 the entire disclosures of the above-mentioned U.S. patents are totally incorporated herein by reference. The appropriate components and process aspects of each of the foregoing U.S. Patents may be selected for the present process and compositions in embodiments thereof.

Surface Additives

In some embodiments, the coalesced hybrid toner particles may be mixed with one or more surface additives, such as silicon dioxide or silica ($SiO_2$), titania or titanium dioxide (TiO2), and/or cerium oxide. These additives may enhance toner flow, tribo control, admix control, improved development and transfer stability, and higher toner blocking temperature. The surface additive(s) may be used with or without a coating or shell.

In some embodiments, silica may include a first silica and a second silica. The first silica may have an average primary particle size, measured in diameter, in the range of, for example, from about 5 nm to about 50 nm, or from about 5 nm to about 25 nm, or from about 20 nm to about 40 nm. The second silica may have an average primary particle size, measured in diameter, in the range of, for example, from about 100 nm to about 200 nm, or from about 100 nm to about 150 nm, or from about 125 nm to about 145 nm. The second silica may have a larger average size (diameter) than the first silica.

Titania may have an average primary particle size in the range of, for example, about 5 nm to about 50 nm, or from about 5 nm to about 20 nm, or from about 10 nm to about 50 nm.

Cerium oxide may have an average primary particle size in the range of, for example, from about 5 nm to about 50 nm, or from about 5 nm to about 20 nm, or from about 10 nm to about 50 nm.

Zinc stearate also may be used as an additive. Calcium stearate and magnesium stearate may provide similar functions. Zinc, calcium or magnesium stearate may also provide developer conductivity, tribo enhancement, higher toner charge, and charge stability. Zinc stearate may have an average primary particle size in the range of, for example, from about 500 nm to about 700 nm, or from about 500 nm to about 600 nm, or from about 550 nm to about 650 nm.

Surface additives may be used in an amount of from about 0.1 to about 10 weight %, or from about 0.5 to about 7 weight %, or from about 1% to about 5 weight % of the hybrid toner particles.

Other examples of surface additives include those disclosed in U.S. Pat. Nos. 3,590,000; 3,720,617; 3,655,374; and 3,983,045, the disclosures of which are hereby incorporated by reference in their entireties.

The gloss of a toner may be influenced by the amount of retained metal ion, such as, Al3+, in a particle. The amount of retained metal ion may be adjusted further by the addition of a chelator, such as EDTA. In some embodiments, the amount of retained catalyst, for example, Al3+, in the hybrid toner particles of the present disclosure may be from about 0.1 pph to about 1 pph, or from about 0.25 pph to about 0.8 pph. The gloss level of a toner of the instant disclosure may have a gloss, as measured by Gardner gloss units (gu), of from about 20 gu to about 100 gu, or from about 50 gu to about 95 gu, or from about 60 gu to about 90 gu.

Other surface additives include lubricants, such as, a metal salt of a fatty acid (e.g., calcium stearate) or long chain alcohols, such as, UNILIN 700 available from Baker Petrolite and AEROSIL R972® available from Degussa. The coated silicas of U.S. Pat. Nos. 6,190,815 and 6,004,714 may also be useful, the disclosures of which are hereby incorporated by reference in their entireties.

Toner Compositions—Developer(s)

The hybrid toner particles thus formed may be formulated into a developer composition. For example, the hybrid toner particles may be mixed with carrier particles to achieve a two component developer composition. The hybrid toner particle concentration in the developer may be from about 1% to about 25% by weight, or from about 2% to about 15% by weight of the total weight of the developer, with the remainder of the developer composition being the carrier. However, different hybrid toner particles and carrier percentages may be used to achieve a developer composition with desired characteristics.

Toner Compositions—Carrier(s)

A toner composition optionally can comprise inert particles, which can serve as hybrid toner particle carriers. The inert particles can be modified, for example, to serve a particular function. Hence, the surface thereof can be derivatized or the hybrid toner particles can be manufactured for a desired purpose, for example, to carry a charge or to possess a magnetic field. Examples of carrier particles for mixing with the hybrid toner particles include those carrier particles that are capable of triboelectrically obtaining a charge of polarity opposite to that of the toner particles. Illustrative examples of suitable carrier particles include granular zircon, granular silicon, glass, steel, nickel, ferrites, iron ferrites, silicon dioxide, one or more polymers and the like. Other carriers include those disclosed in U.S. Pat. Nos. 3,847,604; 4,937,166; and 4,935,326, the disclosures of which are hereby incorporated by reference in their entireties.

In some embodiments, the carrier particles may include a core with a coating thereover, which may be formed from a polymer or a mixture of polymers that are not in close proximity thereto in the triboelectric series, such as those as taught herein or as known in the art. The coating may include fluoropolymers, such as polyvinylidene fluorides, terpolymers of styrene, methacrylates, methyl methacrylates, cyclohexylmethacrylates, copolymers of cylohexyl methacrylates with alklymines meth(acrylates) such as dimethylaminoethyl methacrylate, silanes, such as triethoxy silanes, tetrafluoroethylenes, other known coatings and the like. For example, coatings containing polyvinylidene fluoride available, for example, as KYNAR 301F™, and/or polymethylmethacrylate (PMMA), for example, having a weight average molecular weight of about 300,000 to about 350,000, such as commercially available from Soken, may be used. In some embodiments, PMMA and polyvinylidenefluoride may be mixed in proportions from about 30 to about 70 weight % to about 70 to about 30 weight %, or from about 40 to about 60 weight % to about 60 to about 40 weight %. The coating may have a coating weight of, for example, from about 0.1 to about 5% by weight, or from about 0.5 to about 2% by weight of the carrier. The carrier particles may be prepared by mixing the carrier core with a polymer in an amount of from about 0.05% to about 10% by weight, or from about 0.01% to about 3% by weight, based on the weight of the coated carrier particle, until adherence thereof to the carrier core is obtained, for example, by mechanical impaction and/or electrostatic attraction.

Toner Compositions—Charge Additives

The toner compositions may include any known charge additives in amounts of from about 0.1 to about 10 weight %, or from about 0.5 to about 7 weight % of the toner composition. Examples of such charge additives include alkyl pyridinium halides, bisulfates, the charge control additives of U.S. Pat. Nos. 3,944,493; 4,007,293; 4,079,014; 4,394,430; and 4,560,635, the disclosures of which are hereby incorporated by reference in their entireties, negative charge enhancing additives, such as aluminum complexes, and the like. Charge enhancing molecules can be used to impart either a positive or a negative charge on a toner particle. Examples include quaternary ammonium compounds, as for example in U.S. Pat. No. 4,298,672, the disclosure of which is hereby incorporated by reference in its entirety, organic sulfate and sulfonate compounds, as for example in U.S. Pat. No. 4,338,390, the disclosure of which is hereby incorporated by reference in its entirety, cetyl pyridinium tetrafluoroborates, distearyldimethyl ammonium methylsulfate, aluminum salts and so on.

Toner Compositions—Surfactant(s)

The toner compositions may be in dispersions including surfactants. The surfactants may be selected from ionic surfactants and nonionic surfactants, or combinations thereof as described herein. Anionic surfactants and cationic surfactants are encompassed by the term "ionic surfactants." The surfactant or the total amount of surfactants in a toner composition may be used in an amount of from about 0.01% to about 5%, or from about 0.05% to about 3%, or from about 0.1% to about 2% by weight of the toner composition.

Examples of suitable processes for forming toner particles from latex particles may be found in U.S. Pat. No. 8,192,913, the disclosure of which is hereby incorporated by reference in its entirety.

In embodiments, the toner of the present disclosure may be used for a xerographic print protective composition that provides overprint coating properties including, but not limited to, thermal and light stability and smear resistance, particularly in commercial print applications. More specifically, such overprint coating as envisioned has the ability to permit overwriting, reduce or prevent thermal cracking, improve fusing, reduce or prevent document offset, improve print performance and protect an image from sun, heat and the like. In embodiments, the overprint compositions may be used to improve the overall appearance of xerographic prints due to the ability of the compositions to fill in the roughness of xerographic substrates and toners, thereby forming a level film and enhancing glossiness.

The following Examples are submitted to illustrate embodiments of the disclosure. The Examples are intended to be illustrative only and are not intended to limit the scope of the disclosure. Also, parts and percentages are by weight unless otherwise indicated. As used herein, "room temperature," refers to a temperature of from about 20° C. to about 30° C.

EXAMPLES

The examples set forth herein below are being submitted to illustrate embodiments of the present disclosure. These examples are intended to be illustrative only and are not intended to limit the scope of the present disclosure. Also, parts and percentages are by weight unless otherwise indicated. Comparative examples and data are also provided.

Several continuous coalescence experiments were carried out in order to reduce the present embodiments to practice. The initial experiments were all run utilizing the same 20 gal batch of aggregated slurry. This slurry was used for both continuous coalescence experiments and batch coalescence control experiments to decouple the influence of batch-to-batch variation in aggregation.

Example 1

Preparation of Aggregated Toner Slurry

In a 20 gal reactor, 3.4 kg of an amorphous polyester latex (polyester emulsion A, an amorphous polyester resin in an emulsion, having an average molecular weight (Mw) of about 86,000, a number average molecular weight (Mn) of about 5,600, an onset glass transition temperature (Tg onset) of about 56° C., and about 35% solids), 3.4 kg of a second amorphous polyester latex (Polyester emulsion B, an amorphous polyester resin in an emulsion having an Mw of about 19,400, an Mn of about 5,000, a Tg onset of about 60° C., and about 35% solids), 6.0 kg of a styrene-n-butyl-acrylate latex (emulsion polymerized latex of about 200 nm size with 76.5% styrene and 23.5% nBA, a Mw of 35,000 and a Tg onset of about 51° C., and about 40% solids), 2.1 kg of a crystalline polyester (CPE, a crystalline polyester resin in an emulsion, having an Mw of about 23,300, an Mn of about 10,500, a melting temperature (Tm) of about 71° C. and about 35.4% solids;), 4.2 kg of a carbon black pigment dispersion (NIPEX 35 from Orion Engineered Carbons (Luxembourg)), 0.7 kg of a cyan pigment dispersion (PB15:3), 3.4 kg of a wax dispersion (from IGI Wax (Toronto, Canada)), and 30 kg de-ionized (DI) water was charged. This material was homogenized using a closed loop homogenizer attached to the reactor while a mixture of 0.2 kg poly aluminum chloride solution and 2.4 kg 0.02M Nitric acid solution was added over a period of 5 minutes. The homogenizer was run for a period of approximately 40 minutes before 2 kg of DI water was added to flush the homogenizer loop. The reactor was then mixed at approximately 250-300 RPM while the temperature was ramped to 45° C. over approximately 75 minutes to yield a core particle size of 4.4.94 μm comprising the mixed-composition hybrid core. A shell formulation comprising 9.5 kg of a 76.5 wt %/23.5 wt % styrene-butylacrylate 3 pph 2-carboxyethylacrylate latex, with a 35 K weight average molecular weight, a Tg of 51° C. and a particle size of about 195 nm and 3.0 kg of and DI water was charged to the reactor. The jacket temperature was then raised to 53° C. with an impeller speed of approximately 275 RPM and the shell composition was allowed to aggregate onto the core particles for a period of approximately 70 minutes. The particles were then "frozen" (aggregation stopped) by addition of a 1M solution of sodium hydroxide to yield a pH of 4.2 where the agitation speed was then reduced to 170 RPM, and then the addition of a chelating agent (VERSENE 100, an EDTA-based chelating agent from Dow Chemical (Midland, Mich.)) to raise the pH to 5.6. The reactor was then ramped to 65° C. and held at that temperature for 20 minutes before the reactor was set to full cooling and discharged. This material had a final particle size of 5.42 μm, a GSDv84/50 of 1.22, and a GSDn50/16 of 1.25. This material was used as the feed material in subsequent continuous coalescence examples as well as a comparative batch coalescence example described below.

Example 2

Preparation of Continuously Coalesced Toner Particle Slurry

Briefly, approximately 4 L of aggregated slurry from Example 1, was pH adjusted to 5.6 and charged to feed reactor. The reactor was then pressurized to 40 psi using a pressure regulator. A peristaltic pump at the outlet of the process was set to meter the flow of slurry through the system at 240 mL/min from the feed tank, through the heat exchangers and residence time section, to the pump and out of the system to be collected. The slurry first travels through two shell tube heat exchangers and heated to an outlet temperature of 130° C. (exiting jacket set to 132° C.). The slurry then enters the residence time section having a volume of 240 mL yielding a residence time of 1 minute in the residence time section. The slurry then passes through the final two quenching heat exchangers which are cooled by domestic chilled water (~10° C.) to yield an outlet temperature of approximately 32° C. The slurry then is metered through the pump and collected. The collected toner was measured by a Sysmex FPIA-3000 and the resulting circularity was found to be 0.973. The particle size measured by a Beckman Coulter Multisizer 3 (50 μm aperture tube) was 5.15 μm (D50v) with a GSDv84/50 of 1.23 and a GSDn50/16 of 1.24.

Example 3

Preparation of Continuously Coalesced Toner Particle Slurry

Briefly, approximately 4 L of aggregated slurry from Example 1, was pH adjusted to 6.0 and charged to feed reactor. The reactor was then pressurized to 40 psi using a pressure regulator. A peristaltic pump at the outlet of the process was set to meter the flow of slurry through the system at 240 mL/min from the feed tank, through the heat exchangers and residence time section, to the pump and out of the system to be collected. The slurry first travels through two shell tube heat exchangers and heated to an outlet temperature of 130° C. (exiting jacket set to 132° C.). The slurry then enters the residence time section having a volume of 240 mL yielding a residence time of 1 minute in the residence time section. The slurry then passes through a cooling heat exchanger, which are cooled by domestic chilled water (~10° C.), to an exit temperature of about 65° C. The slurry then passed through a static mixer with inline 1M NaOH addition. The slurry then passed through a final quenching heat exchanger, which are cooled by domestic chilled water (~10° C.), to yield an outlet temperature of approximately 36° C. The slurry then is metered through the pump and collected. The injection rate of 1M NaOH into the system yielded a final pH (measured at outlet temperature) of approximately 10. The collected toner was measured by a Sysmex FPIA-3000 and the resulting circularity was found to be 0.969. The particle size measured by a Beckman Coulter Multisizer 3 (50 μm aperture tube) was 5.21 μm (D50v) with a GSDv84/50 of 1.21 and a GSDn50/16 of 1.23.

Example 4

Preparation of Continuously Coalesced Toner Particle Slurry

Briefly, approximately 4 L of aggregated slurry from Example 1, was pH adjusted to 6.4 and charged to feed reactor. The reactor was then pressurized to 50 psi using a pressure regulator. A peristaltic pump at the outlet of the process was set to meter the flow of slurry through the system at 240 mL/min from the feed tank, through the heat exchangers and residence time section, to the pump and out of the system to be collected. The slurry first travels through two shell tube heat exchangers and heated to an outlet temperature of 140° C. (exiting jacket set to 142° C.). The slurry then enters the residence time section having a volume of 240 mL yielding a residence time of 1 minute in the residence time section. The slurry then passes through a cooling heat exchanger, which are cooled by domestic chilled water (~10° C.), to an exit temperature of about 67° C. The slurry then passed through a static mixer with inline 1M NaOH addition. The slurry then passed through a final quenching heat exchanger (60), which are cooled by domestic chilled water (~10° C.), to yield an outlet temperature of approximately 38° C. The slurry then is metered through the pump and collected. The injection rate of 1M NaOH into the system yielded a final pH (measured at outlet temperature) of approximately 10. The collected toner was measured by a Sysmex FPIA-2100 and the resulting circularity was found to be 0.976. The particle size measured by a Beckman Coulter Multisizer 3 (50 μm aperture tube) was 5.21 μm (D50v) with a GSDv84/50 of 1.21 and a GSDn50/16 of 1.24.

Comparative Example 5

Preparation of a Batch Coalesced Toner Particle Slurry

In a 2 L kettle reactor, approximately 1.5 L of the aggregated slurry from example 1 was loaded. The reactor was then ramped to 96° C. over the course of an hour. While ramping, once the contents had reached 85° C., the pH was lowered to 5.2 using 0.3M nitric acid. Once a temperature of 96° C. was reached, the reactor was held there while stirring. Over the first 85 minutes of the coalescence, the pH drifted from 5.2 to 4.8. Spheroidization was then halted by adjusting the pH to 7.0 using a 1M sodium hydroxide solution. The contents of the reactor were then held at temperature until a total time of 3-hours-at-96° C. was reached. The reactor was then cooled to 68° C. where the pH was adjusted to 8.8. After the pH adjustment at 68° C., the reactor heat was turned off and cooling was applied until the temperature had reached about 25° C. The final particle size for this comparative example was approximately 5.9 μm (D50v) and having a GSDv84/50 of 1.22 and a GSDn50/16 of 1.26.

Results

SEM images of Example 3 and Comparative Example 5 are shown in FIGS. 3A-4B. As seen, the morphology for both the batch and continuously coalesced examples is good and also similar. The smooth surface of the hybrid continuously coalesced particles allows for an even homogeneous distribution of any surface additives, thus making the additives more efficient for adhesion for good toner flow, for reduced adhesion to surfaces such as the photoreceptor or an intermediate transfer belt, which improves toner transfer efficiency ensuring more of the toner ends up on the printed substrate. Fusing characteristics of the toners produced were determined by crease area, minimum fixing temperature, gloss, document offset, and vinyl offset testing.

All unfused images were generated using a modified Xerox copier. A TMA (Toner Mass per unit Area) of 1.00 mg/cm2 was used for the amount of toner placed onto CXS paper (Color Xpressions Select, 90 gsm, uncoated, P/N 3R11540) and used for gloss, crease and hot offset measurements. Gloss/crease targets were a square image placed in the centre of the page.

Samples were then fused with an oil-less fusing fixture, consisting of a Xerox 700 production fuser CRU that was fitted with an external motor and temperature control along with paper transports. Process speed of the fuser was set to 220 mm/s (nip dwell of ~34 ms) and the fuser roll temperature was varied from cold offset to hot offset or up to 210° C. for gloss and crease measurements on the samples. After the set point temperature of the fuser roll has been changed I wait ten minutes to allow the temperature of the belt and pressure assembly to stabilize.

Cold offset is the temperature at which toner sticks to the fuser, but is not yet fusing to the paper. Above the cold offset temperature the toner does not offset to the fuser until it reaches the Hot offset temperature.

The fusing performance of the particles produced in Examples 2 and 3 and Comparative Example 5 are excellent and have a wider fusing latitude than production-scale EA high gloss toner (polyester-type). The fusing results are summarized in Tables 1, 2 and 3 below. The cold offset temperature, which is the lowest temperature at which toner offsets to the fuser roll, was equal or lower by about −4° C. for all hybrid toners, both continuous and batch, compared to production-scale control toner. The MFT for crease area=80 is about 2-4° C. higher than the control toner (Xerox 700 toner) for the continuous hybrid, but 10° C. higher for the batch hybrid. The hybrid toners also do not hot offset at 210° C., which is greater than the control (Xerox 700 toner) as well.

Figure 5:
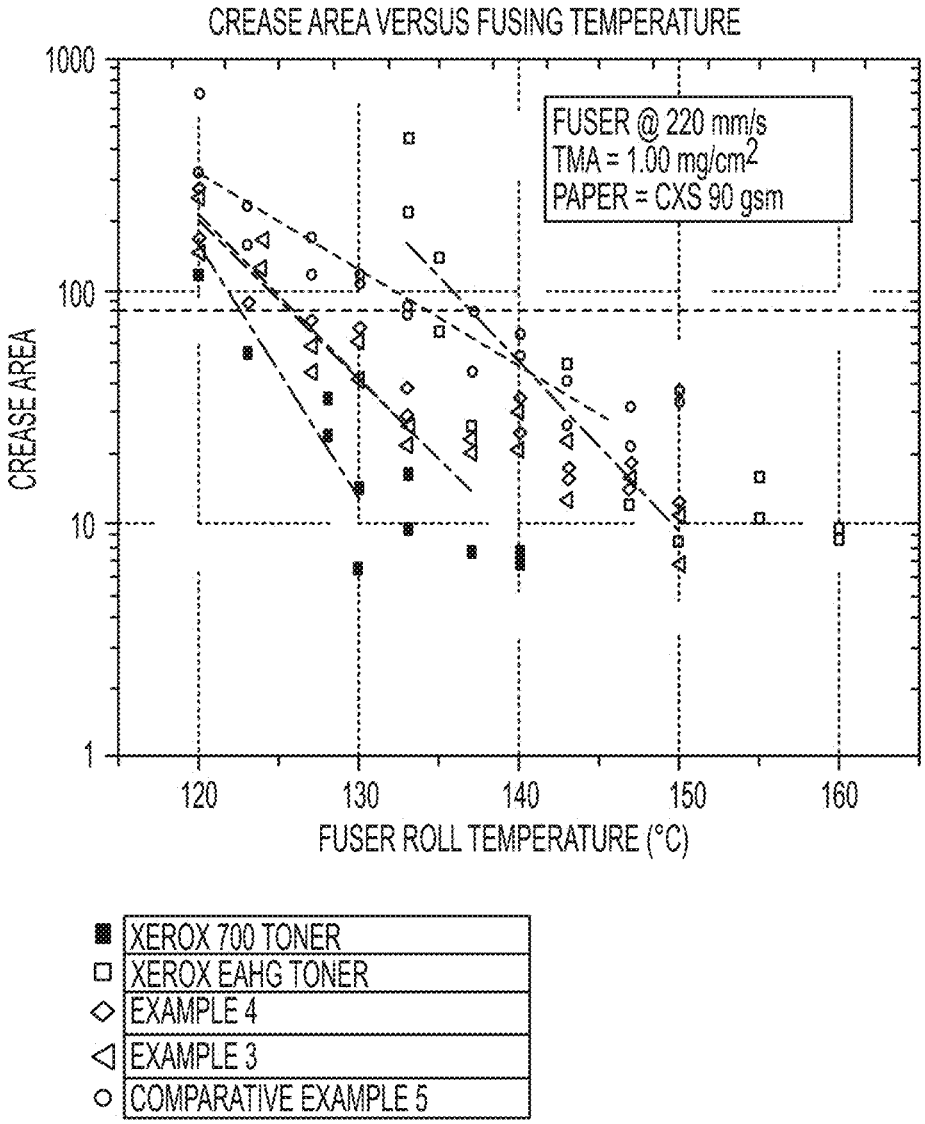
FIG. 5 is a graph illustrating crease area plots of Examples 3, 4 and 5.

Gloss and crease plots are also provided in FIGS. 5 and 6. Print gloss (Gardner gloss units or "ggu") was measured using a 75.degree, BYK Gardner gloss meter for toner images that had been fused at a fuser roll temperature range of about 120.degree. C. to about 210.degree. C. (sample gloss was dependent on the toner, the toner mass per unit area, the paper substrate, the fuser roll, and fuser roll temperature).

The toner image displays mechanical properties such as crease, as determined by creasing a section of the substrate such as paper with a toned image thereon and quantifying the degree to which the toner in the crease separates from the paper. A good crease resistance may be considered a value of less than 1 mm, where the average width of the creased image is measured by printing an image on paper, followed by (a) folding inwards the printed area of the image, (b) passing over the folded image a standard TEFLON coated copper roll weighing about 860 grams, (c) unfolding the paper and wiping the loose ink from the creased imaged surface with a cotton swab, and (d) measuring the average width of the ink free creased area with an image analyzer. The crease value can also be reported in terms of area, especially when the image is sufficiently hard to break unevenly on creasing; measured in terms of area, crease values of 100 millimeters correspond to about 1 mm in width. Further, the images exhibit fracture coefficients, for example of greater than unity. From the image analysis of the creased area, it is possible to determine whether the image shows a small single crack line or is more brittle and easily cracked. A single crack line in the creased area provides a fracture coefficient of unity while a highly cracked crease exhibits a fracture coefficient of greater than unity. The greater the cracking, the greater the fracture coefficient. Toners exhibiting acceptable mechanical properties, which are suitable for office documents, may be obtained by utilizing the aforementioned thermoplastic resins. However, there is also a need for digital xerographic applications for flexible packaging on various substrates. For flexible packaging applications, the toner materials must meet very demanding requirements such as being able to withstand the high temperature conditions to which they are exposed in the packaging process and enabling hot pressure-resistance of the images. Other applications, such as books and manuals, require that the image does not document offset onto the adjacent image. These additional requirements require alternate resin systems, for example that provide thermoset properties such that a crosslinked resin results after fusing or post-fusing on the toner image.

With respect to the gloss shown in FIG. 5, the gloss of the continuous batches is low. This is due to the high residual Al content in these toners (625 ppm for Example 2, 587 ppm for Example 3, 621 ppm for Comparative Example 5, and 581 ppm for Example 4, compared to the EA production-scale toner which is <120 ppm). The Al creates cross-links in the resin that reduces the gloss. The continuous hybrid toners are higher gloss than the batch hybrid. This effect is due to the continuous process, as the Al content is similar for all the hybrid toners.

The Minimum Fixing Temperature (MFT) measurement involves folding an image on paper fused at a specific temperature, and rolling a standard weight across the fold. The print can also be folded using a commercially available folder such as the Duplo D-590 paper folder. The folded image is then unfolded and analyzed under the microscope and assessed a numerical grade based on the amount of crease showing in the fold. This procedure is repeated at various temperatures until the minimum fusing temperature (showing very little crease) is obtained.

Overall, with the hybrid continuous process, the lowest temperature for fusing that meets MFT without cold offset temperature is similar to EA production-scale toner (about 126 to 127° C.), while the HOT latitude is improved over the EA production-scale toner. While the batch hybrid has similar improved HOT, MFT is considerably worse by 10° C. Gloss of the continuous toners was lower than the EA production-scale toner in these examples, but that can be improved by lowering Al.

Table 1 below provides a summary of fusing results for Example 2.

TABLE 1

| | EAHG Production Scale Control | Xerox 700 Toner Production Scale Control | Example 2 |
|---|---|---|---|
| Cold offset (° C.) | 140 | 127 | 123 |
| MFT (° C.) | 139 | 124 | 127 |
| Gloss Mottle (° C.) | 210 | 200 | >210 |
| Hot Offset (° C.) | >210 | 210 | >210 |

Table 2 below provides a summary of fusing results for Examples 3 and 5.

TABLE 2

| | EAHG Production Scale Control | Xerox 700 Toner Production Scale Control | Example 3 | Comparative Example 5 |
|---|---|---|---|---|
| Cold offset (° C.) | 140 | 127 | 123 | 123 |
| MFT (° C.) | 140 | 124 | 126 | 134 |
| Gloss Mottle (° C.) | 210 | 200 | >210 | >210 |
| Hot Offset (° C.) | >210 | >210 | >210 | >210 |

Table 3 below provides a summary of fusing results for Example 4.

TABLE 3

| | EAHG Production Scale Control | Xerox 700 Toner Production Scale Control | Example 4 |
|---|---|---|---|
| Cold offset (° C.) | 140 | 123 | 123 |
| MFT (° C.) | 137 | 123 | 126 |
| Gloss Mottle (° C.) | 205 | 200 | >210 |
| Hot Offset (° C.) | >210 | 210 | >210 |

SUMMARY

As described above, a hybrid particle having a Sty/Ac shell was subjected to both batch and continuous coalescence. An advantage of reduced fusing temperature was observed in the samples having been continuously coalesced compared to batch coalescence, and in general the hybrid approach offers increased fusing latitude to HOT. Most importantly, adding emulsion/polymerized St/Ac latex into a polyester based toner reduces cost significantly compared to current EA production-scale toner, since polyester resin and latex preparation are more expensive than emulsion polymerized St/Ac. In addition there are also potential cost reductions from the implementation of a continuous process which can reduce further manufacturing costs. Quality improvements from continuous process implementation can also be realized, further adding to the benefits of the currently disclosed embodiments.

It will be appreciated that several of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims.

Unless specifically recited in a claim, steps or components of claims should not be implied or imported from the specification or any other claims as to any particular order, number, position, size, shape, angle, color or material.

All references cited herein are herein incorporated by reference in their entireties.

The invention claimed is:

1. A method to produce toner comprising first aggregating at least one polyester latex, and at least one styrene acrylate latex, and optionally a wax dispersion, and optionally a pigment dispersion to form a core, wherein styrene acrylate latex particles are aggregated onto the core to form a shell, and further wherein the resulting aggregated particle is subjected to a continuous coalescence process, comprising:

heating the aggregated particle to a first temperature beyond its glass transition temperature in a first heat exchanger to form a coalesced particles;

quenching the coalesced particles to a second temperature below the glass transition temperature after a residence time; and recovering the quenched coalesced particles at an outlet; wherein the circularity of the aggregated particles is from about 0.900 to about 0.940, and the circularity of the particles in the coalesced particle slurry has increased to a value from about 0.940 to about 0.999 and further wherein the resulting toner comprises a hybrid composition with both styrene/acrylate and polyester.

2. The method of claim 1, wherein the first temperature of continuous coalescence is from about 100° C. to about 150° C.

3. The method of claim 1, wherein the continuous coalescence residence time is from about 0.5 minutes to about 5 minutes.

4. The method of claim 1, wherein the heated hybrid particles exit the first heat exchanger and coalesces in a residence time reactor to form the coalesced particle slurry.

5. The method of claim 1, wherein the toner particles are aggregated by a continuous process.

6. The method of claim 1, wherein the toner particles are aggregated by a batch process.

7. The method of claim 1, wherein the toner particles have a particle size of from about 4 to about 8 μm (D50v).

8. The method of claim 1, wherein the toner particles have a number average geometric standard deviation (GSDn50/16) of from about 1.10 to about 1.40.

9. A toner composition, comprising:

toner particles having a core;

and a shell disposed over the core, wherein the core comprises at least a first polyester polymer and at least a first styrene acrylate polymer; and optionally a wax dispersion, and optionally a pigment dispersion, and further wherein the shell comprises substantially a second styrene acrylate polymer.

10. The toner composition of claim 9, wherein the first and second styrene acrylate polymers are the same.

11. The toner composition of claim 9, wherein the first and second styrene acrylate polymers are different.

12. The toner composition of claim 9, wherein the second styrene acrylate polymers is present in the shell of the toner particles in an amount of up to about 95 weight % of the shell polymers.

13. The toner composition of claim 9, wherein the first polyester polymer is present in the core of the toner particles in an amount of from about 5 weight % to about 95 weight % of the core polymers.

14. The toner composition of claim 9, wherein the first styrene acrylate polymer is present in the core of the toner particles in an amount of from about 5 weight % to about 95 weight % of the core polymers.

15. A method of preparing a toner composition, comprising:

forming toner particles having a core and a shell, wherein forming further comprises coalescing the toner particles by a continuous coalescence process, wherein the core includes at least one polyester polymer and at least one styrene acrylate polymer, and optionally a wax dispersion, and optionally a pigment dispersion; and further aggregating styrene acrylate latex particles onto the core to form a shell; wherein the toner particles have a fusing latitude of from about 100° C. to about 240° C.

16. The toner composition of claim 15, wherein the toner particles have a cold offset temperature of from about 100° C. to about 125° C.

17. The toner composition of claim 15, wherein the toner particles have a minimum fix temperature of from about 100° C. to about 130° C.

18. The toner composition of claim 15, wherein the toner particles have a hot offset temperature of from about 200° C. to about 240° C.

19. The toner composition of claim 15, wherein the at least one polyester polymer is present in the core of the toner particles in an amount of from about 5 weight % to about 95 weight % of the core polymers.

20. The toner composition of claim 15, wherein the at least one styrene acrylate polymer is present in the core of the toner particles in an amount of from about 5 weight % to about 95 weight % of the core polymers.

* * * * *